US011603616B2

(12) United States Patent
Jang et al.

(10) Patent No.: US 11,603,616 B2
(45) Date of Patent: Mar. 14, 2023

(54) WASHING MACHINE AND METHOD OF CONTROLLING THE SAME

(71) Applicant: LG ELECTRONICS INC., Seoul (KR)

(72) Inventors: Minho Jang, Seoul (KR); Jaegwang Bae, Seoul (KR); Hoonbong Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 359 days.

(21) Appl. No.: 15/728,725

(22) Filed: Oct. 10, 2017

(65) Prior Publication Data

US 2018/0100260 A1 Apr. 12, 2018

(30) Foreign Application Priority Data

Oct. 7, 2016 (KR) ..... 10-2016-0129723

(51) Int. Cl.
*D06F 34/18* (2020.01)
*D06F 33/32* (2020.01)
(Continued)

(52) U.S. Cl.
CPC ..... *D06F 34/18* (2020.02); *D06F 23/02* (2013.01); *D06F 33/32* (2020.02); *D06F 37/06* (2013.01);
(Continued)

(58) Field of Classification Search
CPC .. D06F 37/203; D06F 33/02; D06F 2204/065; D06F 39/003; D06F 2202/12;
(Continued)

(56) References Cited

U.S. PATENT DOCUMENTS 5,671,494 A * 9/1997 Civanelli ..... D06F 33/40 68/23.1
5,970,555 A * 10/1999 Baek ..... D06F 34/16 68/12.04
(Continued)

FOREIGN PATENT DOCUMENTS

CN 101311404 11/2008
CN 103225195 7/2013
(Continued)

OTHER PUBLICATIONS

International Search Report dated Feb. 6, 2018 issued in Application No. PCT/KR2017/011106.
(Continued)

*Primary Examiner* — David G Cormier
*Assistant Examiner* — Thomas Bucci
(74) *Attorney, Agent, or Firm* — KED & Associates LLP

(57) ABSTRACT

A washing machine and a method of controlling the same are disclosed. The amount of laundry that is introduced into the washing machine is measured using gravity and inertia applied during the operation of the motor, whereby it is possible to precisely calculate the amount of laundry and to minimize the effects of the initial position of the laundry and the movement of the laundry. In addition, the current value of the motor that is operated is used to measure the amount of laundry without a sensor. Furthermore, the amount of laundry is measured at the rotational speed of the motor at which the laundry clings to the drum, whereby it is possible to minimize an error due to the movement of the laundry to thus improve accuracy. Moreover, it is possible to determine the amount of laundry within a short time. Consequently, it is easy to commence the spin-drying operation, thereby reducing washing time and saving energy.

6 Claims, 15 Drawing Sheets

(51) Int. Cl.

| | |
|---|---|
| ***D06F 23/02*** | (2006.01) |
| ***D06F 37/06*** | (2006.01) |
| ***D06F 37/26*** | (2006.01) |
| ***D06F 37/38*** | (2006.01) |
| *D06F 103/04* | (2020.01) |
| *D06F 103/26* | (2020.01) |
| *D06F 103/38* | (2020.01) |
| *D06F 103/46* | (2020.01) |
| *D06F 105/00* | (2020.01) |
| *D06F 105/46* | (2020.01) |
| *D06F 105/48* | (2020.01) |
| *D06F 105/58* | (2020.01) |
| *D06F 105/60* | (2020.01) |
| *D06F 33/40* | (2020.01) |
| *D06F 33/44* | (2020.01) |

(52) U.S. Cl.
CPC ..... *D06F 37/266* (2013.01); *D06F 37/38* (2013.01); *D06F 33/40* (2020.02); *D06F 33/44* (2020.02); *D06F 2103/04* (2020.02); *D06F 2103/26* (2020.02); *D06F 2103/38* (2020.02); *D06F 2103/46* (2020.02); *D06F 2105/00* (2020.02); *D06F 2105/46* (2020.02); *D06F 2105/48* (2020.02); *D06F 2105/58* (2020.02); *D06F 2105/60* (2020.02)

(58) Field of Classification Search
CPC ..... D06F 2202/10; D06F 2202/065; D06F 2222/00; D06F 37/304
USPC ..... 8/159, 158, 137, 147; 68/12.02, 12.04, 68/12.16, 23.1, 139, 12.01, 12.23
See application file for complete search history.

(56) References Cited

U.S. PATENT DOCUMENTS 6,029,299 A * 2/2000 Baek ..... D06F 34/18 68/12.04
6,240,586 B1 * 6/2001 Joo ..... D06F 33/76 68/12.14
6,640,372 B2 * 11/2003 Ciancimino ..... D06F 33/48 8/159
7,296,445 B2 * 11/2007 Zhang ..... D06F 33/48 8/159
7,530,132 B2 * 5/2009 Kim ..... D06F 35/007 8/158
7,530,133 B2 * 5/2009 Mitts ..... D06F 33/40 68/12.04
7,739,764 B2 * 6/2010 Zhang ..... D06F 34/16 68/12.02
7,739,765 B2 * 6/2010 Ashrafzadeh ..... D06F 13/02 68/12.02
7,752,694 B2 * 7/2010 Koo ..... D06F 33/40 8/159
8,042,211 B2 * 10/2011 Stansel ..... D06F 33/48 8/159
8,122,549 B2 * 2/2012 Park ..... D06F 33/48 8/159
8,151,393 B2 * 4/2012 Bae ..... D06F 33/48 8/159
8,156,592 B2 * 4/2012 Lee ..... D06F 33/48 8/159
8,220,093 B2 * 7/2012 Bae ..... D06F 33/30 8/159
8,281,438 B2 * 10/2012 Bae ..... D06F 34/18 8/158
8,302,232 B2 * 11/2012 Bae ..... D06F 33/40 68/140
8,365,334 B2 * 2/2013 Bae ..... D06F 33/48 68/12.02
8,713,736 B2 * 5/2014 Cho ..... D06F 35/006 68/43
8,938,835 B2 * 1/2015 Bae ..... D06F 35/006 8/158
8,984,693 B2 * 3/2015 Ashrafzadeh ..... D06F 34/16 8/158
2005/0102765 A1 * 5/2005 Jeong ..... D06F 33/48 68/12.02
2005/0115006 A1 * 6/2005 Lee ..... D06F 33/48 8/158
2005/0204482 A1 * 9/2005 Murray ..... D06F 33/48 68/12.02
2005/0251926 A1 * 11/2005 Lee ..... D06F 33/48 8/158
2005/0268670 A1 * 12/2005 Hirasawa ..... D06F 33/40 68/12.02
2007/0044247 A1 * 3/2007 Park ..... D06F 34/16 68/12.02
2008/0289118 A1 * 11/2008 Park ..... D06F 33/48 68/12.02
2009/0106913 A1 * 4/2009 Suel, II ..... D06F 34/18 68/12.23
2009/0183318 A1 * 7/2009 Kim ..... D06F 37/225 8/159
2009/0300852 A1 12/2009 Bae et al.
2010/0031451 A1 * 2/2010 Bae ..... D06F 34/18 68/12.02
2010/0132127 A1 * 6/2010 Sa ..... D06F 33/36 68/12.01
2011/0030149 A1 * 2/2011 Cho ..... D06F 34/08 8/137
2012/0324654 A1 * 12/2012 Koo ..... D06F 33/32 68/12.12
2014/0101865 A1 4/2014 Jang et al.
2014/0215725 A1 * 8/2014 Paglia ..... D06F 35/007 68/12.02
2015/0252509 A1 * 9/2015 Heo ..... D06F 33/48 68/12.06

FOREIGN PATENT DOCUMENTS

| | | | |
|---|---|---|---|
| CN | 103741430 | 4/2014 | |
| CN | 104294544 | 1/2015 | |
| CN | 105256508 | 1/2016 | |
| CN | 105780392 | 7/2016 | |
| EP | 1 995 366 | 11/2008 | |
| EP | 2 128 325 | 12/2009 | |
| JP | 2005-006676 | 1/2005 | |
| JP | 2013-043030 | 3/2013 | |
| JP | 2014-054498 | 3/2014 | |
| KR | 10-2011-0048352 | 5/2011 | |
| KR | 10-2012-0109006 | 10/2012 | |
| KR | 10-2014-0045714 | 4/2014 | |
| KR | 10-2015-0019648 | 2/2015 | |
| KR | 10-2016-0094723 | 8/2016 | |
| WO | WO-2005085511 A1 * | 9/2005 | ..... D06F 39/003 |

OTHER PUBLICATIONS

European Search Report dated Feb. 19, 2018 issued in Application No. 17195423.3.
Chinese Office Action dated Sep. 24, 2020 issued in CN Application No. 201780076275.5.

* cited by examiner (a)

(b)

(a)

(b)

(a)

(b)

WASHING MACHINE AND METHOD OF CONTROLLING THE SAME

CROSS-REFERENCE TO RELATED APPLICATION

This application claims priority under 35 U.S.C. § 119 to Korean Application No. 10-2016-0129723 filed on Oct. 7, 2016, whose entire disclosure is hereby incorporated by reference.

BACKGROUND

1. Field

The present invention relates to a washing machine and a method of controlling the same, and more particularly to a washing machine capable of sensing the amount of laundry that is introduced thereinto and a method of controlling the same.

2. Background

In general, a washing machine is an apparatus that treats laundry through various processes, such as washing, spin drying, and/or drying.

A predetermined amount of wash water is supplied into a drum containing laundry therein. An appropriate amount of detergent is dissolved in the wash water to remove contaminants from the laundry through the chemical action of the detergent. In addition, the drum, in which the laundry is contained, is rotated to easily remove contaminants from the laundry through the mechanical friction between the wash water and the laundry and vibration of the laundry.

In order to remove contaminants from the laundry, a washing cycle, a rinsing cycle, and a spin-drying cycle are performed. During washing of the laundry, a spin-drying operation is performed in the washing cycle and the rinsing cycle as well as in the spin-drying cycle in order to remove water from the laundry.

In the spin-drying operation, a motor is rotated at a high speed. As a result, centrifugal force is applied to the laundry in the drum, whereby water is removed from the laundry.

The spin-drying operation is affected by the amount of laundry and the tangling of laundry, since the motor is rotated at a high speed. As the amount of laundry increases, it is difficult to rotate the motor at a high speed. Furthermore, if the laundry is tangled and is thus collected at one side, the washing machine may be damaged due to unbalance when the motor is rotated at a high speed.

Consequently, the washing machine precisely determines the amount of laundry before the execution of spin drying so as to adjust the rotational speed of the motor for spin drying based on the amount of laundry.

In a conventional washing machine, current supplied to the motor at the time of starting the motor, which is in a stationary state, is measured in order to determine the amount of laundry.

If the amount of laundry is determined at the time of starting the motor, it is difficult to determine a small amount of laundry. In addition, the amount of laundry that is measured may be changed due to the initial position of laundry in a stationary state and the movement of the laundry caused by driving the motor. Particularly, as the amount of laundry increases, variation in the measured value is increased.

In addition, for a washing machine including a sensorless motor, positional alignment is difficult at the time of starting the motor, whereby variation in the measured amount of laundry is increased. If the variation in the measured amount of laundry is increased, it is not possible to determine the amount of laundry based on calculated data.

If the amount of laundry is not precisely measured, it takes a lot of time to perform the spin-drying operation, in which the motor is rotated at a high speed. As a result, the washing time increases, whereby energy consumption increases.

BRIEF DESCRIPTION OF THE DRAWINGS

The embodiments will be described in detail with reference to the following drawings in which like reference numerals refer to like elements wherein.

DETAILED DESCRIPTION

Figure 1:
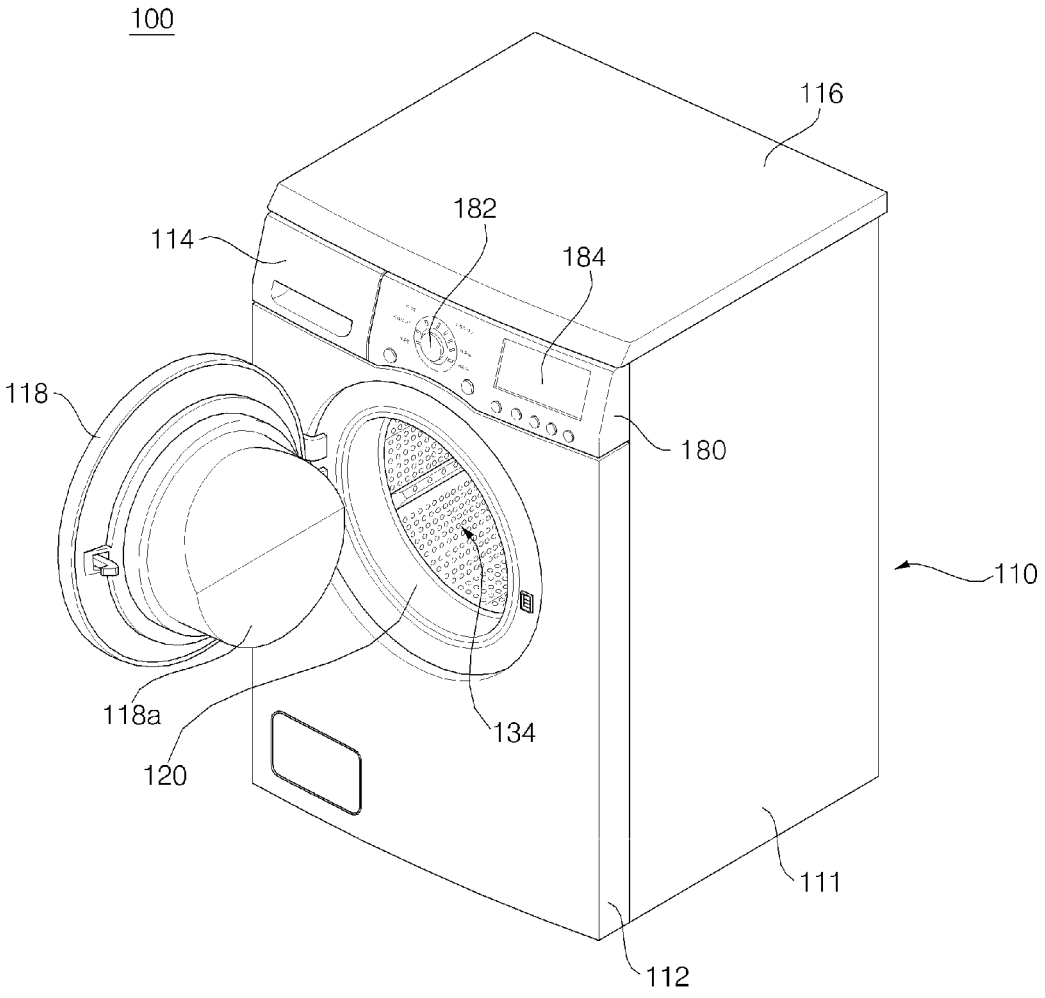
FIG. 1 is a perspective view showing a washing machine according to an embodiment of the present invention.

The advantages and features of the present invention and the way of achieving them will become apparent with reference to embodiments described below in conjunction with the accompanying drawings. However, the present invention is not limited to the embodiments disclosed in the following description but may be embodied in various different forms. The embodiments of the present invention, which will be described below, are provided for completeness of the disclosure of the present invention and to correctly inform those skilled in the art to which the present invention pertains of the scope of the invention. The present invention is defined only by the scope of the accompanying claims. Throughout the specification, the same components are denoted by the same reference numerals. In addition, a controller and other elements included in a washing machine according to the present invention may be realized by one or more processors or a hardware device.

Figure 2:
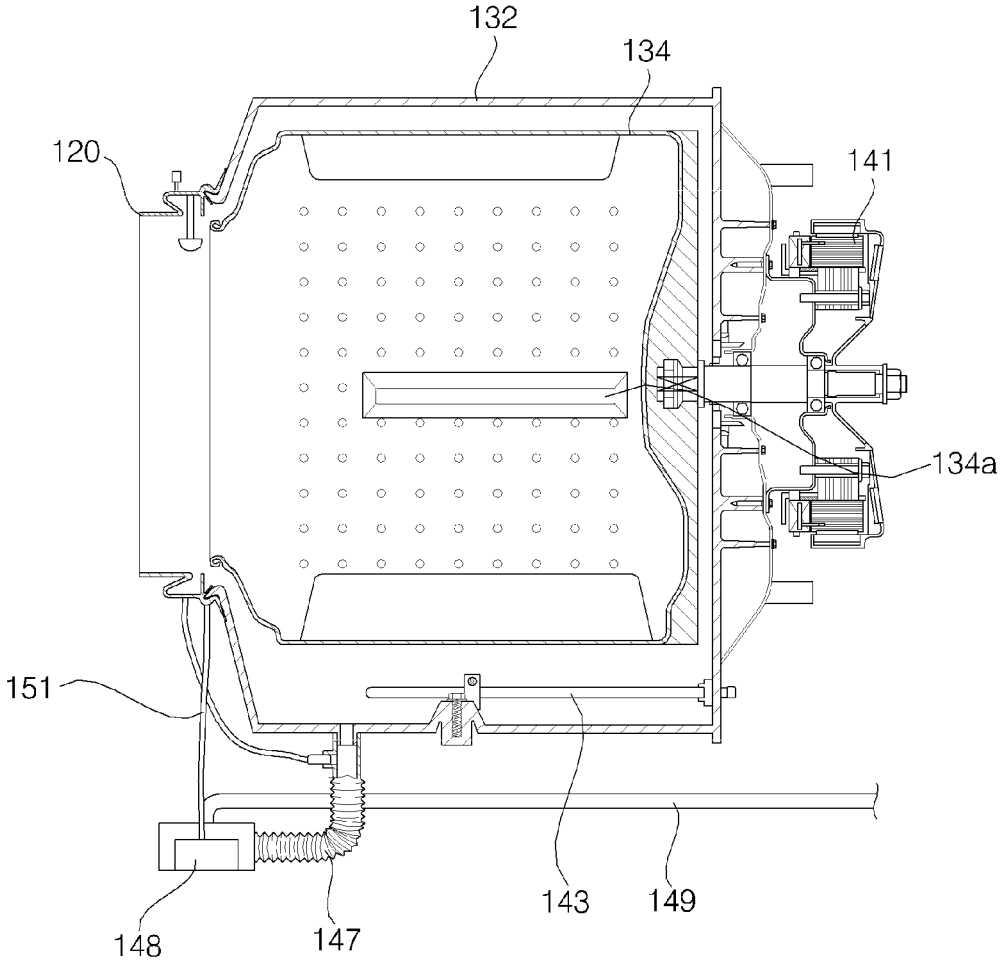
FIG. 2 is a partial sectional view of the washing machine shown in FIG. 1.

FIG. 1 is a perspective view showing a washing machine according to an embodiment of the present invention, and FIG. 2 is a partial sectional view of the washing machine shown in FIG. 1.

A washing machine 100 according to the present invention is configured as shown in FIGS. 1 and 2.

A casing 110 defines the external appearance of the washing machine 100. A tub 132 for containing water is disposed in the casing 110 in a suspended state, and a drum 134 for containing laundry is rotatably provided in the tub 132. A heater 143 for heating the water in the tub 132 may be further provided.

The casing 110 may include a cabinet 111 that defines the external appearance of the washing machine 100, the cabinet 111 having an open front and top, a base (not shown) for supporting the cabinet 111, a front cover 112 coupled to the front of the cabinet 111, the front cover 112 being provided with a laundry introduction hole, through which laundry is introduced, and a top cover 116 provided at the top of the cabinet 111. A door 118 for opening and closing the laundry introduction hole may be disposed at the front cover 112.

The door 118 may be provided with a glass 118*a* such that the laundry in the drum 134 is visible from outside the washing machine 100. The glass 118*a* may be convex. In the state in which the door 118 is closed, the tip end of the glass 118*a* may protrude to the inside of the drum 134.

A detergent box 114 contains additives, such as preliminary or main washing detergent, fabric softener, and bleach. The detergent box 114 is disposed in the casing 110 so as to be capable of being withdrawn therefrom. The detergent box 114 may be partitioned into a plurality of containing spaces, in which the additives are individually contained without being mixed.

In order to absorb vibration generated during the rotation of the drum 134, the tub 132 may be suspended from the top cover 116 via a spring. In addition, a damper may be further provided to support the tub 132 at the lower side thereof.

The drum 134 may be provided with a plurality of holes therein such that water flows between the tub 132 and the drum 134. One or more lifters 134*a* may be provided on the inner circumferential surface of the drum 134 such that laundry is lifted up and dropped during the rotation of the drum 134.

The drum 134 may not be disposed completely horizontally, but may be disposed at a predetermined inclination such that the rear part of the drum 134 is lower than the horizontal line.

A motor for generating driving force necessary to rotate the drum 134 may be provided. The washing machine may be classified as a direct-driving-type washing machine or an indirect-driving-type washing machine depending on how the driving force generated by the motor is transmitted to the drum 134. In the direct-driving-type washing machine, a rotary shaft of the motor is directly fastened to the drum 134. The rotary shaft of the motor and the center of the drum 134 are aligned with each other on the same line. In the direct-driving-type washing machine, the drum 134 is rotated by a motor 141 disposed in a space between the rear of the tub 132 and the cabinet 111.

In the indirect-driving-type washing machine, the drum 134 is rotated using a power transmission means, such as a belt or a pulley, for transmitting the driving force generated by the motor. The rotary shaft of the motor and the center of the drum 134 are not necessarily aligned with each other on the same line.

The washing machine according to the present invention may be either a direct-driving-type washing machine or an indirect-driving-type washing machine.

A gasket 120 is provided between the casing 110 and the tub 132. The gasket 120 prevents the water contained in the tub 132 from leaking to a space between the tub 132 and the casing 110. One side of the gasket 120 is coupled to the casing 110, and the other side of the gasket 120 is coupled to the circumference of the open front of the tub 132. In addition, the gasket 120 is compressed according to the vibration of the tub 132 to absorb the vibration.

The gasket 120 may be made of a deformable or flexible material that is somewhat elastic. For example, the gasket 120 may be made of natural rubber or synthetic resin.

The washing machine is connected to a hot water source H.W. for supplying hot water and a cold water source C.W. for supplying cold water via a hot water hose and a cold water hose, respectively. Water introduced via the hot water hose and the cold water hose is supplied to the detergent box 114, a steam generator, and/or a swirl nozzle under the control of a water supply unit.

A pump 148 drains water discharged from the tub 132 through a drain bellows 147 to the outside via a drain hose 149 or sends the water to a circulation hose 151. In this embodiment, the pump 148 performs both the function of a drain pump and the function of a circulation pump. Depending on the circumstances, a drain pump and a circulation pump may be provided separately.

During the rotation of the drum 134, laundry 10 is repeatedly lifted up by the lifters 134*a* and dropped. When the drum is rotated at a high speed, the laundry clings to the wall of the drum. At this time, wash water is separated from the laundry by centrifugal force, and is discharged to the tub through the holes formed in the drum. In this way, spin drying is performed.

A control panel 180 may include a course selection unit 182 for allowing a user to select a course and a display unit 184 for allowing the user to input various control commands and displaying the operating state of the washing machine 100.

Figure 3:
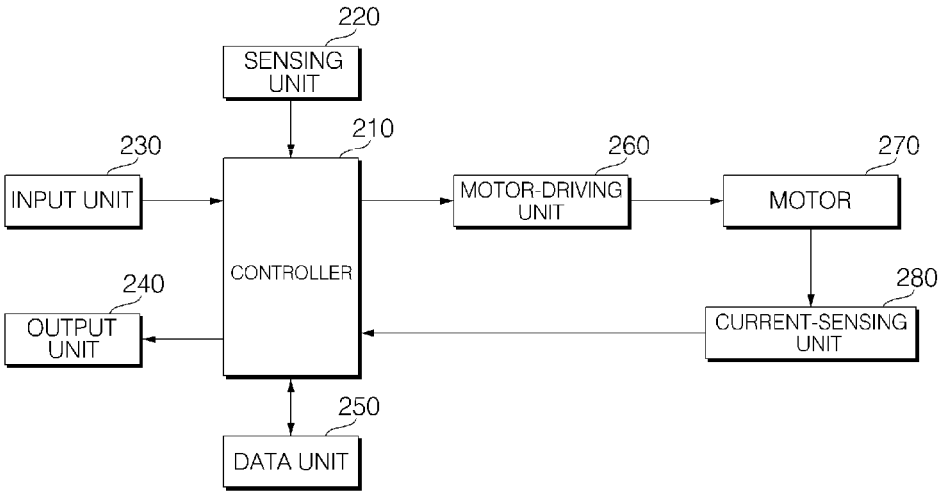
FIG. 3 is a block diagram showing a control construction of the washing machine according to an embodiment of the present invention.

FIG. 3 is a block diagram showing a control construction of the washing machine according to an embodiment of the present invention.

As shown in FIG. 3, the washing machine 100 includes an input unit 230, an output unit 240, a sensing unit 220, a motor-driving unit 260, a motor 270, a current-sensing unit 280, a data unit 250, and a controller 210 for controlling the overall operation of the washing machine, in addition to the structural elements described above.

In addition, the controller 210 controls a water supply valve and a drain valve. The washing machine may further include a control construction for heating wash water. Depending on the circumstances, a communication unit for transmitting and receiving data to and from the outside may be further provided. However, a description thereof will be omitted. The controller 210 may be realized by one or more processors or a hardware device.

The input unit 230, including an input means, such as at least one button, a switch, and a touchpad, allows the user to input operation settings, such as a power on/off input, a washing course, a water level, and a temperature. When a washing course is selected through the course selection unit 182, the input unit 230 transmits data on the selected washing course to the controller.

The output unit 240 includes a display unit 184 for displaying information about the operation setting input through the input unit 230 and outputting the operating state of the washing machine. In addition, the output unit 240 further includes a speaker or a buzzer for outputting a predetermined sound effect or alarm.

The data unit 250 stores control data for controlling the operation of the washing machine, data on the input operation setting, data on the washing course, and reference data for determining whether an error has occurred in the washing machine. In addition, the data unit 250 stores data that is sensed or measured by the sensing unit during the operation of the washing machine.

The data unit 250 stores various kinds of information necessary to control the washing machine. The data unit 250 may include a volatile or nonvolatile recording medium. The recording medium stores data that can be read by the microprocessor. The recording medium may include a hard disk drive (HDD), a solid-state disk (SSD), a silicon disk drive (SDD), a ROM, a RAM, a CD-ROM, a magnetic tape, a floppy disk, and an optical data storage device.

The sensing unit 220, including a plurality of sensors, measures the voltage or current of the washing machine, and senses data, such as the rotational speed of the motor, the temperature of wash water, the level of the wash water, and the pressure of the wash water that is supplied or drained, which are transmitted to the controller 210.

The sensing unit 220 includes a plurality of sensors, each of which may be selected from among a current sensor, a voltage sensor, a water level sensor, a temperature sensor, a pressure sensor, and a speed sensor.

The water level sensor is mounted in the drum or the tub to sense the level of wash water and transmit water level data to the controller 210. The temperature sensor measures the temperature of wash water. In addition, a plurality of temperature sensors may be provided at different positions to sense the temperature in a control circuit and the temperature of a heater for heating or drying wash water, if the heater is provided, as well as to sense the temperature of wash water. The current-sensing unit 280 measures the current that is supplied to the motor, and transmits the measured current to the controller 210. The speed sensor senses the rotational speed of the motor and transmits the sensed rotational speed of the motor to the controller. The speed sensor may be connected to the rotary shaft of the motor to sense the rotational speed of the motor based on the voltage output therefrom. Alternatively, a photoelectric sensor may be mounted to the rotary shaft of the motor to sense the rotational speed of the motor. However, the present invention is not limited thereto. Various other sensing means may be used.

The motor 270 is connected to the drum to generate power necessary to rotate the drum. A sensorless motor may be used as the motor 270.

The motor-driving unit 260 supplies operating power to the motor 270. The motor-driving unit 260 controls the motor to operate or stop in response to a control command from the controller 210. In addition, the motor-driving unit 260 controls the rotational speed of the motor.

The motor-driving unit 260 controls the rotational direction, rotational angle, and rotational speed of the motor 270 in response to a control command from the controller 210. In addition, the motor-driving unit 260 controls the motor 270 to operate differently based on a predetermined washing course and on each of the washing, rinsing, and spin-drying cycles that are performed. At this time, the motor-driving unit 260 controls the rotational direction, rotational angle, and rotational speed of the motor 270 variably such that the wash water in the drum forms a specific form of water current.

The controller 210 controls water supply and drainage depending on the operation setting input through the input unit 230. In addition, the controller 210 generates a control command such that the drum is rotated to perform washing according to the operation of the motor 270, and transmits the control command to the motor-driving unit 260. The controller 210 may control a series of washing processes, such as washing, rinsing, and spin drying.

The controller 210 stores the received operation setting to the data unit 250, and outputs the operation setting or the operating state of the washing machine through the output unit 240. Depending on the circumstances, in the case in which there is a terminal that has a washing machine control application installed therein and is wirelessly connected to the washing machine, the controller may transmit data on the operation setting to the terminal.

While washing is being performed, the controller 210 determines whether the washing is being performed normally based on data received from the sensors of the sensing unit 220 and data received from the current-sensing unit 280. Upon determining that the washing is being abnormally performed, the controller 210 outputs an error through the output unit 240.

For example, when the level of wash water does not reach a predetermined water level within a water supply time during the supply of water, when the level of wash water does not reach an empty water level within a predetermined drainage time while the water is being drained, when the empty water level is sensed during the execution of washing, when the temperature of wash water does not reach a predetermined temperature, or when spin drying is not performed a predetermined number of times or within a predetermined amount of time, the controller 210 determines that an error has occurred.

The controller 210 transmits a control command to the motor-driving unit 260 such that a washing, rinsing, or spin-drying process is performed according to the operation setting. When the motor is operated, the controller 210 stores and analyzes a current value received from the current-sensing unit 280 to determine the state of the motor and, in addition, to determine the amount of laundry contained in the drum. In addition, the controller 210 determines deviation of laundry, i.e. the unbalance of laundry, based on the measured current.

Particularly, when washing is commenced and the drum is rotated at a high speed, the controller 210 determines the amount of laundry in the drum. Even after the controller 210 has determined the amount of laundry, the controller 210 determines the amount of laundry again before high-speed rotation of the drum when the high-speed rotation of the drum is needed such that the drum is rotated at a high speed in response to the determined amount of laundry. At this time, the controller 210 may change and set the maximum rotational speed in response to the determined amount of laundry.

When the motor is rotated by the motor-driving unit 260, the controller 210 transmits a control command to the motor-driving unit 260 such that the rotational speed of the motor increases or decreases stepwise. During the rotation of the motor, the controller 210 analyzes the current value received from the current-sensing unit 280 in an acceleration period, a maintenance period, and a deceleration period in order to determine the amount of laundry.

The controller 210 calculates gravity and inertial force applied to the drum during the rotation of the motor and counter-electromotive force generated when the motor is braked to determine the amount of laundry.

Figure 4:
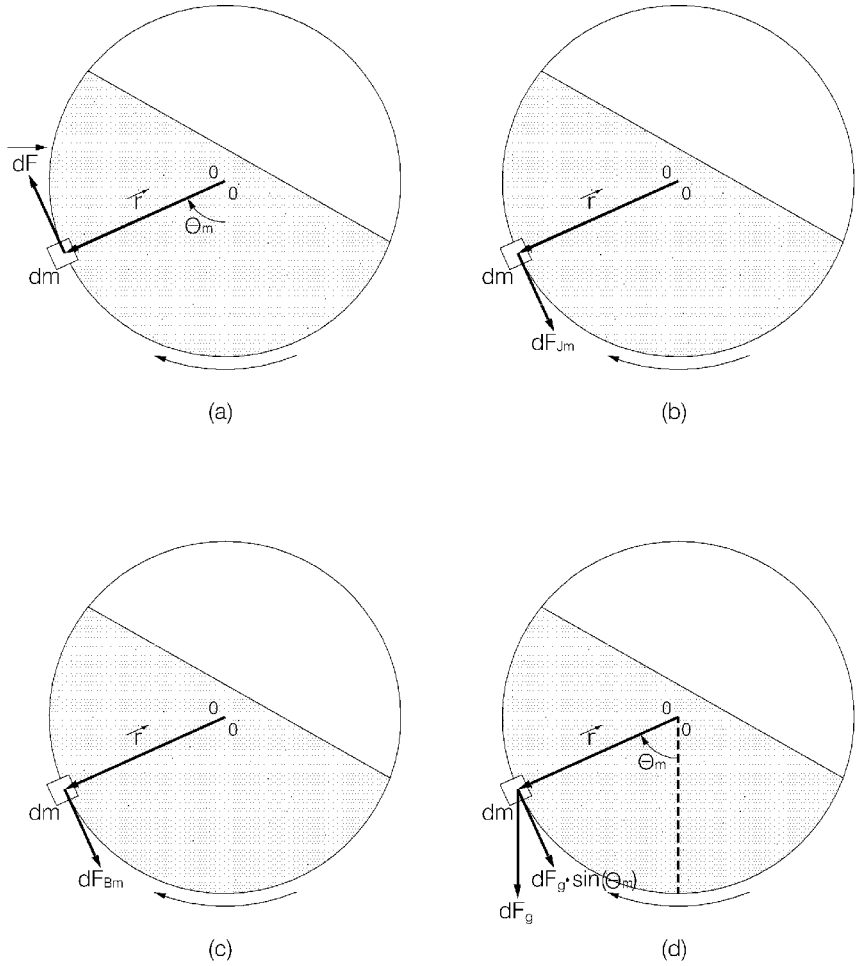
FIG. 4 is a reference view illustrating the application of force to laundry in the washing machine according to the embodiment of the present invention.

FIG. 4 is a reference view illustrating the application of force to laundry in the washing machine according to the embodiment of the present invention.

As previously described, the controller 210 determines the amount of laundry using the force applied to the drum.

As shown in FIG. 4, various forces are applied to the drum, in which laundry is placed.

The washing machine separates foreign matter from the laundry and removes wash water from the laundry using the rotation of the drum. Consequently, motor torque, inertial torque, frictional torque, and load torque are applied to rotate the drum.

The motor torque is force that is applied to rotate the motor, which is connected to the drum. The inertial torque is force that impedes the rotation of the drum due to inertia, by which the existing operating state (rotation) is maintained, when the drum is accelerated or decelerated during the rotation of the drum. The frictional torque is force that impedes the rotation of the drum due to the friction between the drum and the laundry, between the door and the laundry, or between individual laundry items. The load torque is force that impedes the rotation of the drum due to the weight of laundry.

The washing machine does not determine the amount of laundry at the time of starting the motor but determines the amount of laundry during the rotation of the drum. Hereinafter, therefore, the application of force to laundry at an angle θm will be described by way of example.

As shown in FIG. 4(*a*), motor torque Te is force necessary at the time of operating the motor. Consequently, the motor torque Te is expressed as the sum of inertial torque, frictional torque, and load torque. The motor torque Te is the product of force necessary to lift up the laundry and the radius r of the drum.

As shown in FIG. 4(*b*), inertial torque Jm is applied as force that impedes the rotation of the drum due to inertia based on the distribution of the laundry in the drum when the drum is accelerated or decelerated during the rotation of the drum.

At this time, the inertial torque is proportional to mass m and the square of the radius of the drum.

As shown in FIG. 4(*c*), frictional torque Bm is frictional force that is applied between the laundry and the tub and between the laundry and the door. Consequently, the frictional torque is proportional to rotational speed Wm. The frictional torque may be the product of the coefficient of friction and the rotational speed.

As shown in FIG. 4(*d*), load torque TL is gravity that is applied depending on the distribution of the laundry at the time of starting the motor. The load torque may be calculated from the weight (mass m) of the laundry, acceleration due to gravity g, the radius r of the drum, and the angle θm.

Force applied to the laundry at the angle θm is force Fg due to gravity g. Since the drum is rotated, however, the force may be calculated as the product of the gravity and sin(θm). The force Fg due to gravity is decided by acceleration due to gravity, the radius of the drum, and the mass of the laundry.

During the rotation of the drum, the motor torque, the inertial torque, the frictional torque, and the load torque are applied simultaneously. These force components are reflected in the current value of the motor. Consequently, the controller 210 calculates the amount of laundry using the current value measured by the current-sensing unit during the operation of the motor.

The motor torque is greatly affected by gravity due to the weight of the laundry. When the weight of the laundry exceeds a predetermined weight, resolution is lowered. That is, if the amount of laundry exceeds a predetermined level, discrimination due to the weight of the laundry is reduced as the amount of laundry increases.

When there is friction between the laundry and the door and when the laundry is caught in the door, a change in the value of the frictional torque increases, with the result that the frictional torque is distributed. Particularly, when the amount of laundry increases, the distribution of the frictional torque greatly increases.

The value of the load torque is deviated due to the movement of the laundry. In addition, when the weight of the laundry exceeds a predetermined level, the movement of the laundry is reduced. As a result, the load torque is reduced.

In contrast, the inertial torque exhibits linearity with respect to the amount (weight) of laundry, although the inertial torque is affected by the movement of the laundry. Consequently, it is possible to more precisely measure the amount of laundry.

Since the inertial torque is resting force, the inertial torque is applied at the time of acceleration or deceleration. That is, the inertial torque is applied in the acceleration period and the deceleration period. In the case in which the rotational speed is uniform, however, no inertial torque is applied, and the motor torque, the frictional torque, and the load torque are applied.

The characteristics of the inertial torque may be calculated by excluding data in the maintenance period from data in the acceleration period and the deceleration period. Inertia may be calculated by subtracting the current value in the maintenance period from the current value in the acceleration period and the current value the deceleration period, dividing the resultant value by the variation of speed per unit time, i.e. acceleration, and multiplying the resultant value by counter-electromotive force.

Consequently, the washing machine may analyze the force applied in the acceleration period, the deceleration period, and the maintenance period to determine the amount of laundry based on the inertial torque. In addition, the washing machine may calculate gravity depending on the amount of laundry in the maintenance period. In addition, the washing machine may calculate counter-electromotive force generated by braking in the deceleration period in order to calculate the amount of laundry.

In addition, since the washing machine measures the current value during the rotation of the motor in order to calculate a laundry-amount sensing value, an error due to the alignment of the motor at the time of starting the motor may be eliminated. In addition, the laundry moves uniformly without the change of a load, i.e. without irregular movement of the laundry, in the maintenance period, whereby it is possible to minimize an error due to the change of the load.

At this time, the washing machine differently applies laundry amount data for calculating the laundry-amount sensing value in the maintenance period and laundry amount data for calculating the laundry-amount sensing value in the acceleration and deceleration periods. In the maintenance period, the characteristics of inertia are minimized. In the acceleration period and the deceleration period, inertia is strongly applied. Consequently, the laundry-amount sensing values are calculated based on different data and compared with each other to determine the final amount of laundry.

As previously described, the controller 210 calculates the inertial torque applied during the operation of the motor to determine the amount of laundry. Consequently, the controller 210 performs control to accelerate or decelerate the motor after the rotational speed of the motor is increased to a predetermined rotational speed. The controller 210 divides the maintenance period, the acceleration period, and the deceleration period from each other based on the rotational speed of the motor, and determines the amount of laundry using current values measured in the respective periods during the operation of the motor.

The controller 210 calculates the amount of laundry using the frictional torque and the load torque, which are affected by gravity in the maintenance period, in which the motor is rotated at a low speed, accelerates the motor starting in the maintenance period such that the characteristics of the inertial torque are emphasized at a rotational speed of the motor that is higher than that in the maintenance period in order to determine the amount of laundry using inertia in the acceleration period. In addition, the controller calculates counter-electromotive force in the deceleration period in order to determine the amount of laundry. The counter-electromotive force is electromotive force that is generated by current formed from the motor in the opposite direction when the motor is braked.

The controller 210 calculates the average of current values on a per-period basis when the rotational speed of the motor is maintained, accelerated, and decelerated in order to determine the amount of laundry.

The controller 210 multiplies the averages of the current values for the respective periods by counter-electromotive force to calculate the amount of laundry. The amount of laundry in the acceleration period is determined based on the laundry amount data for inertia, and the amount of laundry in the maintenance period is determined based on the laundry amount data for gravity. In addition, since the characteristics of the motor based on the kind or performance of the motor are reflected in the counter-electromotive force, the counter-electromotive force is used in calculating the amount of laundry in order to compensate therefor. At this time, the controller 210 may subtract the current value in the maintenance period from the current value in the acceleration period and multiply the resultant value by the counter-electromotive force to calculate data based on the characteristics of the inertia.

Figure 5:
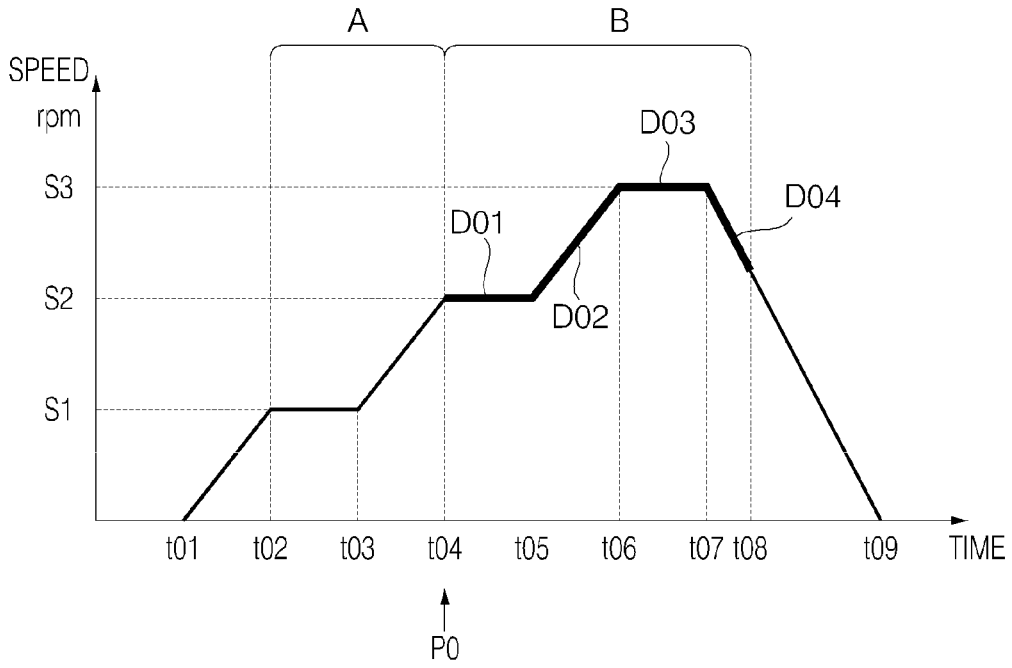
FIG. 5 is a reference view illustrating a first sensing period and a second sensing period during which the amount of laundry is measured in the washing machine according to the embodiment of the present invention.

FIG. 5 is a reference view illustrating a method of measuring the amount of laundry in the washing machine according to the embodiment of the present invention.

As shown in FIG. 5, the controller 210 controls the rotational speed of the motor in order to determine the amount of laundry. The controller 210 compares the current values in the acceleration period and the maintenance period with each other and calculates the counter-electromotive force in the deceleration period to determine the amount of laundry.

The controller 210 sets a plurality of sensing periods based on the rotational speed of the motor and determines the amount of laundry using a current value measured by the current-sensing unit in each sensing period.

The controller 210 senses unbalance in the first sensing period A and performs laundry dispersion in order to reduce the unbalance. In addition, the controller 210 performs laundry-amount sensing in the second sensing period B.

The controller 210 sets a period during which the motor is rotated at a rotational speed that is lower than the rotational speed of the motor at which the laundry completely clings to the wall of the drum as the first sensing period.

In addition, the controller 210 sets a period during which the motor is rotated at a rotational speed that is equal to or higher than the rotational speed of the motor at which the laundry completely clings to the wall of the drum as the second sensing period. If the motor is rotated at a predetermined rotational speed or higher, however, resonance occurs. Consequently, the controller 210 sets the second sensing period within a rotational speed that is lower than the rotational speed of the motor at which resonance occurs.

The controller 210 performs controls such that the rotational speed of the motor is maintained at a predetermined rotational speed, accelerated, and decelerated in the first and second sensing periods. In addition, the controller 210 determines the amount of laundry based on current values measured by the current-sensing unit in the maintenance period, during which the rotational speed of the motor is maintained, the acceleration period, during which the rotational speed of the motor is accelerated, and the deceleration period, during which the rotational speed of the motor is decelerated, and counter-electromotive force.

The controller 210 senses unbalance in the first sensing period. If the unbalance is lower than a predetermined level, the controller 210 performs laundry-amount sensing in the second sensing period. If the unbalance is equal to or greater than the predetermined level, the controller 210 performs control such that the first sensing period is executed again to perform laundry dispersion.

If the laundry is tangled or collected at one side, with the result that unbalance is sensed as being equal to or greater than the predetermined level, the controller 210 performs laundry dispersion in the first sensing period in order to reduce the unbalance.

The controller 210 performs control such that the first sensing period is executed again to sense unbalance again. If the unbalance is lower than the predetermined level, the controller 210 such that the second sensing period is executed. If the unbalance is equal to or higher than the predetermined level, the controller 210 performs control such that the first sensing period is executed again to perform laundry dispersion.

If the first sensing period is repeated at least a predetermined number of times, the controller 210 determines that an error has occurred, and finishes the operation of determining the amount of laundry without executing the second sensing period. If the first sensing period is repeated the predetermined number of times and the second sensing period is not executed normally, the controller 210 outputs an error through the output unit.

The washing machine is vibrated by unbalance that occurs due to tangling of the laundry or collection of the laundry at one side. The magnitude of vibration due to unbalance increases in proportion to the rotational speed of the drum. In the case in which the laundry completely clings to the wall of the drum due to centrifugal force and rotates along with the drum without dropping, the drum may collide with the case of the washing machine due to vibration generated by unbalance. Unbalance may occur at a low speed. However, the possibility of the drum being damaged by vibration generated during low-speed rotation of the drum is low.

Consequently, the controller 210 senses unbalance in the first sensing period A, before the second sensing period B, during which the motor is rotated at a rotational speed that is equal to or higher than the rotational speed of the motor at which the laundry completely clings to the wall of the drum, is executed, in order to determine whether laundry-amount sensing is to be performed in the second sensing period B.

When the laundry-amount sensing is performed normally in the second sensing period B, the controller 210 determines the amount of laundry based on data measured in the second sensing period B.

The controller 210 sets the rotational speed of the motor at which the laundry completely clings to the wall of the drum due to centrifugal force and rotates along with the drum without dropping as a first speed S2.

In addition, the controller 210 sets a rotational speed of the motor which is higher than the first speed S2, at which the effect of gravity is less as centrifugal force in the drum increases, i.e. at which the effect of gravity applied to the laundry is approximately zero, and at which no resonance occurs, as a second speed S3.

For example, the first speed S2 may be set in the range from 70 rpm to 85 rpm, and the second speed S3 may be set in the range from 95 rpm to 110 rpm. However, the rotational speed may be changed depending on the size of the drum and the kind and performance of the motor.

The controller 210 generates a control command for maintaining, accelerating, and decelerating the rotational speed of the motor within a range from the first speed S2 to the second speed S3 in the second sensing period B, and transmits the generated control command to the motor-driving unit 260.

The controller 210 generates a control command for maintaining, accelerating, and decelerating the rotational speed of the motor within a range from a third speed S1 to the first speed S2 in the first sensing period A, and transmits the generated control command to the motor-driving unit 260. As a result, laundry dispersion is performed in the first sensing period A.

The controller 210 sets a rotational speed of the motor at which centrifugal force generated in the drum by the rotation of the motor is equal to gravity and at which the laundry does not cling to the wall of the drum due to the rotation of the drum but is lifted up and drops, whereby the movement of laundry is the greatest, as the third speed S1. The third speed S1 is lower than the first speed S2.

For example, the third speed S1 ranges from 45 rpm to 55 rpm. The rotational speed may be changed depending on the size of the drum and the kind and performance of the motor.

As previously described, the laundry does not cling to the wall of the drum but is lifted up and drops at the third speed S1. In the first sensing period A, therefore, the movement of laundry is great, whereby the laundry may be dispersed.

In order to determine the amount of laundry, the controller 210 transmits a control command for performing operations in the first sensing period A and the second sensing period B to the motor-driving unit 260 to control the rotational speed of the motor.

The current-sensing unit 280 measures a current value in the first sensing period, and transmits the measured current value to the controller 210. The current-sensing unit 280 measures current values in a maintenance period, an acceleration period, and a deceleration period, constituting the second sensing period, and transmits the measured current values to the controller 210.

In response to the control command, the motor-driving unit 260 starts the motor at a first time t01, and accelerates the motor until the rotational speed of the motor reaches the third speed S1.

When the rotational speed of the motor reaches the third speed S1, the motor-driving unit 260 maintains the rotational speed of the motor at the third speed S1 for a predetermined amount of time t02 to t03 in the first sensing period A in response to the control command. At this time, the laundry is lifted up and drops in the drum, whereby the laundry is dispersed.

The motor-driving unit 260 accelerates the motor to the first speed S2 at the third time t03. When the rotational speed of the motor reaches the first speed S2 at a fourth time t04 (P0), the current-sensing unit 280 measures the current value of the motor, and transmits the measured current value of the motor to the controller 210, which senses unbalance based on the measured current value of the motor.

When the unbalance is lower than a predetermined level, the controller 210 controls the motor-driving unit such that the second sensing period B is executed.

In response to the control command, the motor-driving unit 260 maintains the rotational speed of the motor at the first speed S2 for a predetermined amount of time, i.e. during a maintenance period D01 from the fourth time t04 to a fifth time t05.

The current-sensing unit 280 measures the current of the motor in the maintenance period D01 from the fourth time t04 to the fifth time t05, and transmits the measured current of the motor to the controller 210.

The motor-driving unit 260 accelerates the rotational speed of the motor to the second speed S3 at the fifth time t05 (an acceleration period D02). When the rotational speed of the motor reaches the second speed S3, the motor-driving unit 260 maintains the rotational speed of the motor at the second speed during a maintenance period D03 from a sixth time t06 to a seventh time t07. At this time, each maintenance period may be set in the range from 1.5 to 2.5 seconds.

The current-sensing unit 280 measures current in the acceleration period D02 from the fifth time t05 to the sixth time t06 and the maintenance period D03 from the sixth time t06 to the seventh time t07, and transmits the measured current to the controller 210.

After the maintenance period D03, the motor-driving unit 260 brakes the motor at the seventh time t07 to decelerate the rotational speed of the motor. As a result, the motor stops at a ninth time t09.

The current-sensing unit 280 measures current for a predetermined amount of time after deceleration, i.e. in a deceleration period D04 from the seventh time t07 to the eighth time t08, which is a portion of the amount of time from the seventh time t07 to the ninth time t09 during which the rotational speed of the motor is decelerated, and transmits the measured current to the controller 210.

As a result, the controller 210 senses unbalance based on the current value in the first sensing period A, received from the current-sensing unit 280, in order to determine whether the second sensing period B is to be executed. When the second sensing period B is executed normally, the controller calculates current values in the maintenance periods D01 and D02, during which the first speed S2 and the second speed S3 are respectively maintained, a current value in the acceleration period D02, and counter-electromotive force in the deceleration period D04 in order to determine the amount of laundry.

The controller 210 calculates the characteristics of gravity in the maintenance periods and the characteristics of inertia in the acceleration period in order to determine the amount of laundry. The characteristics of inertia in the acceleration period may be calculated by subtracting the current values in the maintenance periods from the current value in the acceleration period. Gravity is strongly applied in the maintenance periods, but the speed is maintained uniform. Consequently, less inertia is applied in the maintenance periods. In the acceleration period, gravity is applied, and at the same time the speed is changed, with the result that inertia, which acts to maintain the existing speed of rotation, is strongly applied. Consequently, it is possible to calculate the characteristics of inertia by subtracting data in the maintenance periods from data in the acceleration period.

Figure 6:
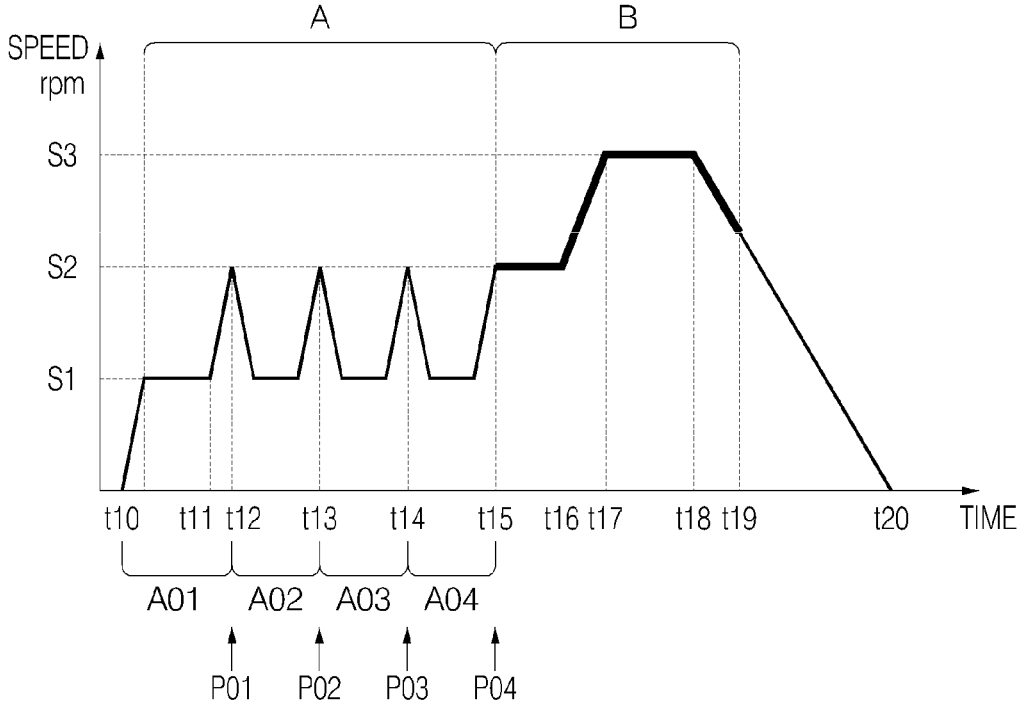
FIG. 6 is a reference view illustrating a change in the speed of a motor due to unbalance in the first sensing period when the amount of laundry is measured as shown in FIG. 5.

FIG. 6 is a reference view illustrating a change in the speed of the motor due to unbalance in the first sensing period when the amount of laundry is measured as shown in FIG. 5.

The controller 210 senses unbalance in the first sensing period A in order to determine whether the second sensing period is to be executed. If the unbalance sensed in the first sensing period is equal to or higher than the predetermined level, the controller 210 performs control such that the second sensing period is not executed, the first sensing period is repeated to disperse the laundry, and unbalance is sensed again in order to execute the second sensing period.

As shown in FIG. 6, in response to the control command, the motor-driving unit 260 starts the motor at a tenth time t10 and accelerates the motor until the rotational speed of the motor reaches the third speed S1.

When the rotational speed of the motor reaches the third speed S1, the motor-driving unit 260 maintains the rotational speed of the motor at the third speed S1 for a predetermined amount of time in the first sensing period A in response to the control command. At this time, the laundry is lifted up and drops in the drum, whereby the laundry is dispersed.

The motor-driving unit 260 accelerates the motor at an eleventh time t11 until the rotational speed of the motor reaches the second speed S2. When the rotational speed of the motor reaches the first speed S2 at a twelfth time t12, the controller 210 senses unbalance based on a current value received from the current-sensing unit.

For example, the controller 210 may analyze ripples in the current value to sense unbalance. This is an example of an unbalance-sensing method. However, the present invention is not limited thereto. Various other unbalance-sensing methods may be used.

The current-sensing unit may transmit a current value in a 1-1 sensing period A01 to the controller.

When the unbalance sensed at a first point P01 is lower than the predetermined level, the controller 210 controls the motor-driving unit such that the second sensing period B is executed, as previously described. When the unbalance is equal to or higher than the predetermined level, the controller 210 performs control such that the first sensing period is executed again.

In response to the control command, the motor-driving unit 260 brakes the motor to decelerate the rotational speed of the motor to the third speed S1, and executes a 1-2 sensing period A02.

When the rotational speed of the motor reaches the third speed S1, the motor-driving unit 260 maintains the rotational speed of the motor at the third speed for a predetermined amount of time. While the rotational speed of the motor is maintained at the third speed, the laundry is dispersed. The motor-driving unit 260 accelerates the motor to the first speed S2.

When the rotational speed of the motor reaches the first speed S2 at a thirteenth time T13, the controller 210 senses unbalance based on a current value in the 1-2 sensing period A02, received from the current-sensing unit 280, at a second point P02.

When the unbalance is lower than the predetermined level, the controller controls the motor-driving unit such that the second sensing period B is executed, as previously described. When the unbalance is equal to or higher than the predetermined level, the controller 210 performs control such that the first sensing period is executed again.

In response to the control command, the motor-driving unit 260 brakes the motor to decelerate the rotational speed of the motor to the third speed S1, and execute a 1-3 sensing period A03. The motor-driving unit 260 maintains the rotational speed of the motor at the third speed in order to disperse the laundry, and then accelerates the motor to the first speed S2.

The controller 210 performs control such that the first sensing period is executed again based on the unbalance in the 1-3 sensing period A03, and the motor-driving unit 260 brakes the motor in order to execute a 1-4 sensing period A04 (t14 to t15).

The controller 210 senses unbalance based on data in the 1-4 sensing period A04. When the unbalance is lower than the predetermined level, the controller controls the motor-driving unit such that the second sensing period B is executed.

The motor-driving unit 260 maintains the rotational speed of the motor at the first speed S2 for a predetermined amount of time, i.e. for an amount of time ranging from a fifteenth time t15 to a sixteenth time t16, and accelerates the rotational speed of the motor to the second speed S3 (t16 to t17). When the rotational speed of the motor reaches the second speed S3, the motor-driving unit 260 maintains the rotational speed of the motor at the second speed S3 for a predetermined amount of time t17 to t18, and brakes the motor such that the motor is decelerated and stopped (t18 to t20).

The current-sensing unit 280 measures currents in the maintenance period from the fifteenth time t15 to the sixteenth time t16, the acceleration period from the sixteenth time t16 to the seventeenth time t17, the maintenance period from the seventeenth time t17 to the eighteenth time t18, and the deceleration period from the eighteenth time t18 to the nineteenth time t19, and transmits the measured currents to the controller 210.

The controller 210 calculates the amount of laundry based on the current in the maintenance periods, the acceleration period, and the deceleration period and on counter-electromotive force.

If the first sensing period is repeated at least a predetermined number of times, the controller 210 determines that an error has occurred, finishes the operation, and outputs an error. That is, since the sensed unbalance is equal to or higher than the predetermined level even though the first sensing period is repeated the at least predetermined number of times to repeatedly disperse the laundry, the controller outputs an error. In addition, if the first sensing period is continuously repeated, the next operation cannot be performed, whereby washing time increases. For this reason, the first sensing period is set to be repeated a predetermined number of times.

Figure 7:
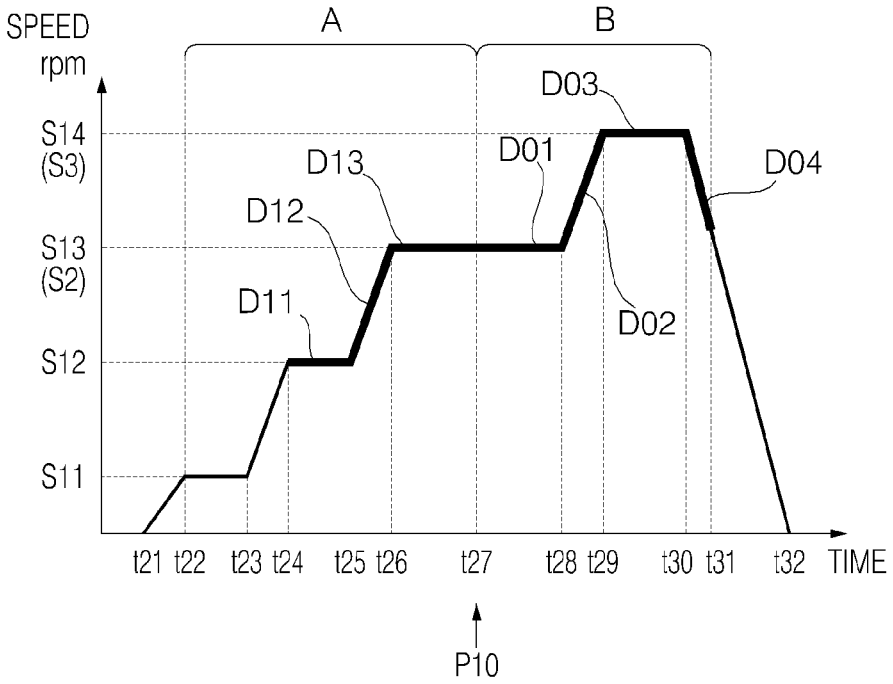
FIG. 7 is a view showing another example of a first sensing period and a second sensing period during which the amount of laundry is measured in the washing machine according to the embodiment of the present invention.

FIG. 7 is a view showing another example of a first sensing period and a second sensing period during which the amount of laundry is measured in the washing machine according to the embodiment of the present invention.

As shown in FIG. 7, the controller 210 controls the rotational speed of the motor in order to determine the amount of laundry.

The controller 210 sets a first sensing period A and a second sensing period B based on the rotational speed of the motor at which the laundry completely clings to the wall of the drum, i.e. a first speed S13 (S2).

In order to determine the amount of laundry, the controller 210 transmits a control command for the first sensing period A and the second sensing period B to the motor-driving unit 260.

The controller 210 performs control such that the rotational speed of the motor is maintained at a predetermined rotational speed, accelerated, and decelerated in the first and second sensing periods. In addition, the controller 210 determines the amount of laundry based on current values measured by the current-sensing unit in the maintenance period, during which the rotational speed of the motor is maintained, the acceleration period, during which the rotational speed of the motor is accelerated, and the deceleration period, during which the rotational speed of the motor is decelerated, and counter-electromotive force.

The current-sensing unit 280 measures currents in a maintenance period, an acceleration period, and a deceleration period constituting each of the first and second sensing periods A and B, and transmits the measured currents to the controller 210.

The controller 210 senses unbalance in the first sensing period A. If the unbalance is lower than a predetermined level, the controller 210 performs laundry-amount sensing in the second sensing period B. If the unbalance is equal to or higher than the predetermined level, the controller 210 executes the first sensing period again such that laundry dispersion and laundry-amount sensing are performed in the first sensing period.

If the laundry is tangled or collected at one side, with the result that unbalance is sensed as being equal to or higher than the predetermined level, the controller 210 performs laundry dispersion in the first sensing period in order to reduce the unbalance. If the second sensing period is not executed, laundry-amount sensing is performed in the first sensing period in order to determine the amount of laundry based on data in the first sensing period.

When the laundry-amount sensing is performed normally in the second sensing period B, the controller 210 discards data measured in the first sensing period A, and determines the amount of laundry based on data measured in the second sensing period B.

Meanwhile, in the case in which the first sensing period A is repeated at least a predetermined number of times n, with the result that the operation is finished without executing the second sensing period B, the controller 210 determines the amount of laundry based on data measured in first sensing period A. In addition, since the first sensing period has been repeated the predetermined number of times, the controller 210 outputs an error through the output unit 240.

The controller 210 controls the motor-driving unit 260 such that laundry dispersion and laundry-amount sensing are performed in the first sensing period A and such that laundry-amount sensing is performed in the second sensing period B.

As described with reference to FIG. 5, the controller 210 generates a control command for maintaining, accelerating, and decelerating the rotational speed of the motor within a range from the first speed S13 (S2) to a second speed S14 (S3) in the second sensing period B, and transmits the generated control command to the motor-driving unit 260. The second sensing period B is set identical to the second sensing period of FIG. 5, and therefore a detailed description thereof will be omitted.

The controller 210 generates a control command for maintaining, accelerating, and decelerating the rotational speed of the motor within a range from a fourth speed S11 to the first speed S13 (S2) in the first sensing period A, and transmits the generated control command to the motor-driving unit 260. As a result, laundry dispersion and laundry-amount sensing are performed in the first sensing period A.

The controller 210 sets the rotational speed of the motor at which the laundry tumbles in the rotating drum as the fourth speed S11.

In addition, the controller 210 sets the rotational speed of the motor at which the laundry starts to cling to the wall of the drum by centrifugal force generated in the drum as the rotational speed of the motor increases, at which some of the laundry rotates along with the drum in the state of clinging to the wall of the drum, and at which some of the laundry is lifted up and dropped by the rotation of the drum as a fifth speed S12. The rotational speed may be changed depending on the size of the drum and the kind and performance of the motor.

Here, the fourth speed S11 is lower than the third speed S1, and the fifth speed S12 is higher than the third speed S1 and lower than the first speed S13 (S2).

In response to the control command, the motor-driving unit 260 starts the motor at a $21^{st}$ time t21, and accelerates the motor until the rotational speed of the motor reaches the fourth speed S11.

When the rotational speed of the motor reaches the fourth speed S11, the motor-driving unit 260 maintains the rotational speed of the motor at the fourth speed S11 for a predetermined amount of time t22 to t23 in the first sensing period A in response to the control command. At this time, the laundry tumbles in the drum as the drum is rotated, whereby the laundry is dispersed.

The motor-driving unit 260 accelerates the motor to the fifth speed S12 at a $23^{rd}$ time t23.

When the rotational speed of the motor reaches the fifth speed S12, the motor-driving unit 260 maintains the rotational speed of the motor at the fifth speed S12 for a predetermined amount of time t24 to t25.

The current-sensing unit 280 measures current in a maintenance period D11 during which the rotational speed of the motor is maintained at the fifth speed S12, and transmits the measured current to the controller 210.

The motor-driving unit 260 accelerates the rotational speed of the motor to the first speed S13 (S2) at the $25^{th}$ time t25. The current-sensing unit 280 measures current in an acceleration period D12 during which the rotational speed of the motor is accelerated from the fifth speed S12 to the first speed S13 (S2), and transmits the measured current to the controller 210.

When the rotational speed of the motor reaches the first speed S13 (S2), the motor-driving unit 260 maintains the rotational speed of the motor at the first speed S13 (S2) for a predetermined amount of time t26 to t27.

The current-sensing unit 280 measures current in a maintenance period D13 during which the rotational speed of the motor is maintained at the first speed S13 (S2), and transmits the measured current to the controller 210.

At the time, the controller 210 senses unbalance based on the current in the maintenance period during which the rotational speed of the motor is maintained at the first speed S13 (S2), which is a portion of the first sensing period A (P10). Depending on the circumstances, the controller 210 may sense unbalance based on all currents in the first sensing period.

When the unbalance is lower than the predetermined level, the controller 210 performs control such that the second sensing period B is executed. At this time, the predetermined level of the unbalance is the level before the amount of laundry is measured. Consequently, a reference level of unbalance in the case in which the amount of laundry is large is set to a predetermined level of unbalance in order to determine the unbalance.

Consequently, the motor-driving unit 260 maintains the rotational speed of the motor at the first speed S13 (S2) for a predetermined amount of time t27 to t28 (a maintenance period D01), accelerates the motor to the second speed S14 (S3) (an acceleration period D02), maintains the rotational speed of the motor at the second speed S14 (S3) for a predetermined amount of time t29 to t30 (a maintenance period D03), and brakes the motor to decelerate the rotational speed of the motor (a deceleration period D04).

The current-sensing unit 280 measures currents in the maintenance period D01, the acceleration period D02, the maintenance period D03, and the deceleration period D04, which is a portion of an amount of time ranging from the $30^{th}$ time t30 to a 32nd time t32, of the second sensing period B, and transmits the measured currents to the controller 210.

When the second sensing period is executed in the state in which the unbalance measured in the first sensing period A is less than the predetermined level, the controller 210 discards the current value in the first sensing period A, measured by the current-sensing unit, and determines the amount of laundry based on the current values in the maintenance periods, the acceleration period, and the deceleration period of the second sensing period B.

The controller 210 calculates the characteristics of gravity in the maintenance periods and the characteristics of inertia in the acceleration period in order to determine the amount of laundry. The characteristics of inertia in the acceleration period may be calculated by subtracting the current values in the maintenance periods from the current value in the acceleration period. Gravity is strongly applied in the maintenance periods, but the speed is maintained uniform. Consequently, less inertia is applied in the maintenance periods. In the acceleration period, gravity is applied, and at the same time the speed is changed, with the result that inertia, which acts to maintain the existing speed of rotation, is strongly applied. Consequently, it is possible to calculate the characteristics of inertia by subtracting data in the maintenance periods from data in the acceleration period.

Meanwhile, when the unbalance in the first sensing period is equal to or higher than the predetermined level, the controller 210 performs control such that the first sensing period is repeated.

Figure 8:
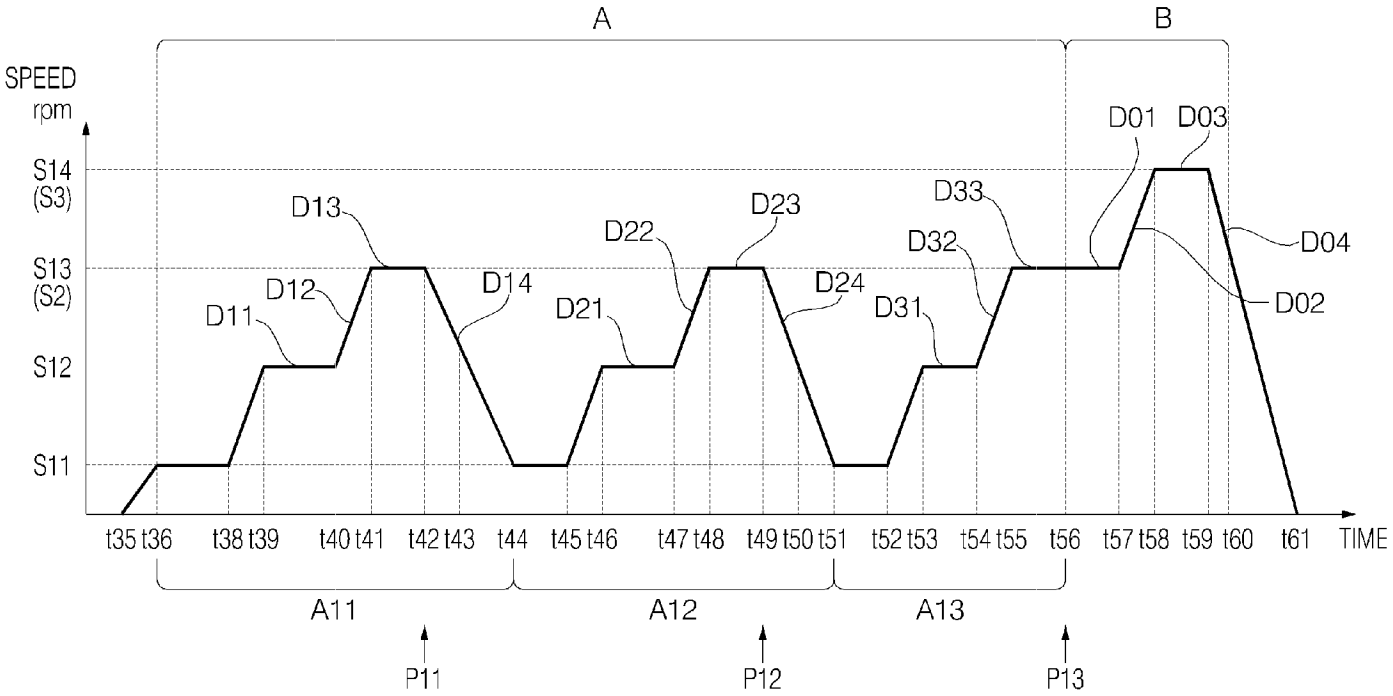
FIG. 8 is a reference view illustrating a change in the speed of the motor due to unbalance in the first sensing period when the amount of laundry is measured as shown in FIG. 7.

FIG. 8 is a reference view illustrating a change in the speed of the motor due to unbalance in the first sensing period when the amount of laundry is measured as shown in FIG. 7.

As shown in FIG. 8, in response to the control command from the controller 210, the motor-driving unit 260 starts the motor 270 at a $35^{th}$ time t35 and accelerates the motor to the fourth speed S11.

When the rotational speed of the motor reaches the fourth speed S11, the motor-driving unit 260 maintains the rotational speed of the motor at the fourth speed S11 for a predetermined amount of time t36 to t38 in the first sensing period A. The laundry tumbles in the drum as the drum is rotated, whereby the laundry is dispersed.

The motor-driving unit 260 accelerates and maintains the rotational speed of the motor for an amount of time ranging from the $38^{th}$ time t38 to a $42^{nd}$ time t42 such that the rotational speed of the motor is accelerated to the first speed S13 (S2) and is then maintained. The current-sensing unit 280 measures currents in the maintenance period D11, during which the rotational speed of the motor is maintained at the fifth speed S12, the acceleration period D12 during which the rotational speed of the motor is accelerated to the first speed, and the maintenance period D13 during which the rotational speed of the motor is maintained at the first speed, and transmits the measured currents to the controller 210.

The controller 210 senses unbalance based on the current in the maintenance period during which the rotational speed of the motor is maintained at the fifth speed (P11).

When the unbalance is equal to or higher than the predetermined level, the washing machine may be damaged when the motor is rotated at a high speed. Consequently, the controller 210 performs control such that the second sensing period B is not executed but the first sensing period A is executed again in order to disperse the laundry.

The motor-driving unit 260 brakes the motor at the $42^{nd}$ time t42 until the rotational speed of the motor reaches the fourth speed S11. At this time, the current-sensing unit 280 measures current in the deceleration period D14.

When the rotational speed of the motor reaches the fourth speed S11 at a $44^{th}$ time t44, the motor-driving unit 260 finishes the operation in a 1-1 sensing period A11 and starts to perform the operation in a 1-2 sensing period A12.

The motor-driving unit 260 maintains the rotational speed of the motor at the fourth speed S11 for an amount of time ranging from the $44^{th}$ time t44 to a $45^{th}$ time t45. The laundry tumbles in the drum as the drum is rotated, whereby the laundry is dispersed.

The motor-driving unit 260 accelerates the motor at the $45^{th}$ time t45 until the rotational speed of the motor reaches the fifth speed S12.

When the rotational speed of the motor reaches the fifth speed S12, the motor-driving unit 260 maintains the rotational speed of the motor at the fifth speed S12 for a predetermined amount of time t46 to t47. The current-sensing unit 280 measures current in a maintenance period D21 during which the rotational speed of the motor is maintained at the fifth speed S12, and transmits the measured current to the controller 210.

The motor-driving unit 260 accelerates the rotational speed of the motor to the first speed S13 (S2) at the $47^{th}$ time t47. The current-sensing unit 280 measures current in an acceleration period D22 during which the rotational speed of the motor is accelerated from the fifth speed S12 to the first speed S13 (S2), and transmits the measured current to the controller 210.

When the rotational speed of the motor reaches the first speed S13 (S2), the motor-driving unit 260 maintains the rotational speed of the motor at the first speed S13 (S2) for a predetermined amount of time t48 to t49.

The current-sensing unit 280 measures current in a maintenance period D23 during which the rotational speed of the motor is maintained at the first speed S13 (S2), and transmits the measured current to the controller 210.

At the time, the controller 210 senses unbalance based on the current in the maintenance period D23 during which the rotational speed of the motor is maintained at the first speed S13 (S2), which is a portion of the first sensing period A, particularly the 1-2 sensing period A12 (P12).

When the unbalance is lower than the predetermined level, the controller 210 performs control such that the second sensing period B is executed. When the unbalance is equal to or higher than the predetermined level, the controller 210 performs control such that the first sensing period is executed again.

Consequently, the motor-driving unit decelerates the rotational speed of the motor to the fourth speed S11 to finish the 1-2 sensing period, and starts to execute a 1-3 sensing period A13. At this time, the current-sensing unit measures current in a deceleration period D24, and transmits the measured current to the controller 210.

The motor-driving unit repeatedly maintains and accelerates the rotational speed of the motor in a stepwise manner for an amount of time ranging from a $51^{st}$ time t51 to a $56^{th}$ time t56 in the 1-3 sensing period A13 until the rotational speed of the motor changes from the fourth speed S11 to the first speed S13 (S2). The current-sensing unit measures currents in maintenance periods D31 and D33 and an acceleration period D32, and transmits the measured currents to the controller 210.

The controller 210 senses unbalance again at the $56^{th}$ time t56 (P13). When the unbalance is lower than the predetermined level, the controller performs control such that the second sensing period B is executed.

Consequently, the motor-driving unit 260 maintains the rotational speed of the motor at the first speed S13 (S2) for a predetermined amount of time t56 to t57 (a maintenance period D01), accelerates the motor to the second speed S14 (S3) (an acceleration period D02), maintains the rotational speed of the motor at the second speed S14 (S3) for a predetermined amount of time t58 to t59 (a maintenance period D03), and brakes the motor to decelerate the rotational speed of the motor (a deceleration period D04).

The current-sensing unit 280 measures currents in the maintenance period D01, the acceleration period D02, the maintenance period D03, and the deceleration period D04 (from t59 to t60), which is a portion of an amount of time ranging from the $59^{th}$ time t59 to a $61^{st}$ time t61, of the second sensing period B, and transmits the measured currents to the controller 210.

The controller 210 calculates the average of the current values in the second sensing period B on a per-period basis and calculates counter-electromotive force in order to determine the amount of laundry.

When the laundry-amount sensing is performed normally in the second sensing period B, the controller 210 discards data measured in the first sensing period A, and determines the amount of laundry based on data measured in the second sensing period B.

If the unbalance is equal to or higher than the predetermined level even after the first sensing period is repeated a predetermined number of times, the controller 210 performs control such that the second sensing period B is not executed but the operation is finished in the first sensing period. If the second sensing period is not executed due to unbalance, the controller 210 outputs an error. The predetermined number of times may be set in the range from 5 to 7 times. However, the present invention is not limited thereto.

In the case in which the first sensing period A is repeated at least a predetermined number of times n, with the result that the operation is finished without executing the second sensing period B, the controller 210 determines the amount of laundry based on data measured in the first sensing period A.

The controller 210 calculates the averages of the current values in the maintenance periods, the acceleration period, and the deceleration period of each of the sub-periods A11 to A13 constituting the first sensing period A, and calculates counter-electromotive force in the deceleration period in order to determine the amount of laundry in the first sensing period A.

Upon determining the amount of laundry, the controller 210 performs control such that the next operation is performed.

Figure 9:
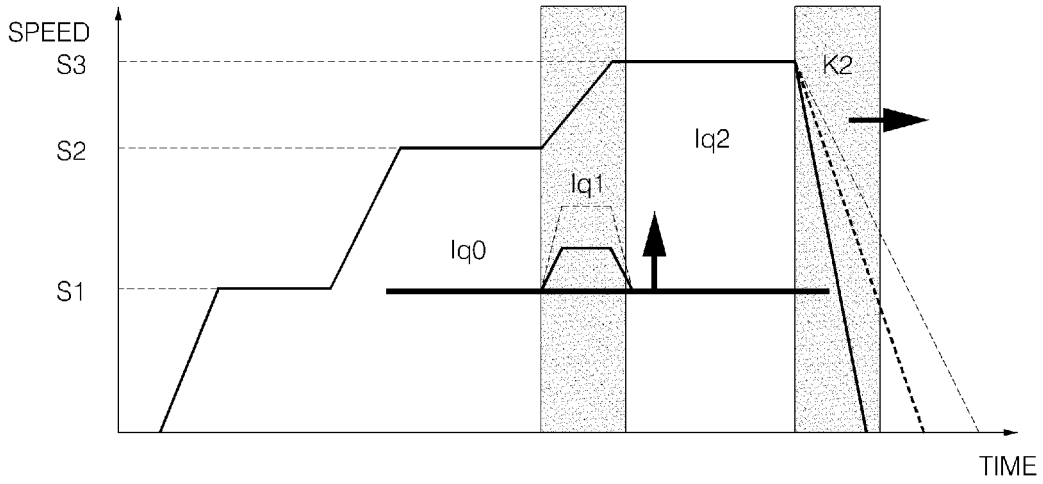
FIG. 9 is a reference view illustrating a current value based on a change in the speed of the motor when the amount of laundry is measured in the washing machine according to the present invention.

FIG. 9 is a reference view illustrating a current value based on a change in the speed of the motor when the amount of laundry is measured in the washing machine according to the present invention.

As shown in FIG. 9, the current Iq0 of the motor is maintained uniform in a maintenance period during which the rotational speed of the motor is maintained at the first speed S2.

In an acceleration period during which the rotational speed of the motor is accelerated from the first speed to the second speed, the current Iq1 of the motor increases to a predetermined value, is maintained, and decreases. At this time, the current value varies depending on the degree of acceleration.

In addition, the current Iq2 of the motor is maintained uniform in a maintenance period during which the rotational speed of the motor is maintained at the second speed.

In the maintenance period, the current is maintained uniform. However, ripples are generated in the current value due to vibration of the drum or the washing tub. At this time, the magnitude of vibration varies depending on the extent of unbalance, with the result that the magnitude of the ripples varies. Consequently, the controller 210 may sense unbalance by analyzing the ripples.

FIG. 9 shows a change of current. The current values in the first speed maintenance period and the second speed maintenance period are not always the same. In the maintenance periods, current is maintained uniform, but the current values may vary depending on the speed of the motor.

The controller 210 may add the current values in the first speed maintenance period and the second speed maintenance period to calculate the average thereof, subtract the resultant value from the average of the current values in the acceleration period, multiply the resultant value by counter-electromotive force, and divide the resultant value by gravitational acceleration in order to calculate the characteristics of inertia.

Figure 10:
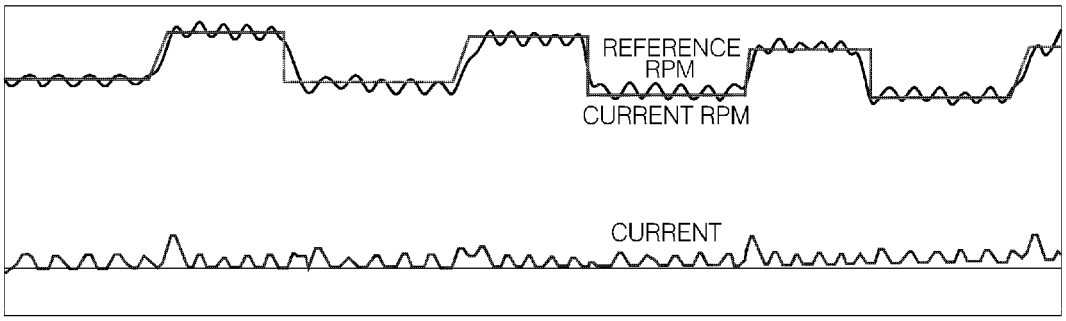
FIG. 10 is a view showing current values measured during the rotation of the motor in the washing machine according to the present invention.
Figure 10:
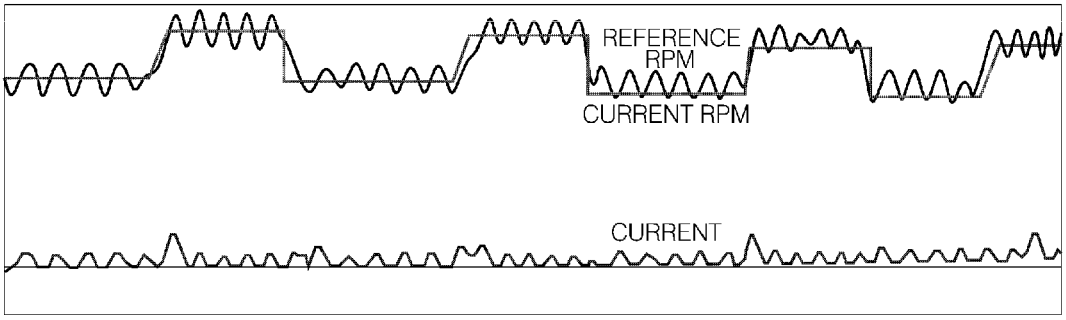

FIG. 10 is a view showing current values measured during the rotation of the motor in the washing machine according to the present invention.

FIGS. 10(*a*) and (*b*) show currents measured during the rotation of the motor.

When the laundry is tangled, when the laundry is collected at one side, or when a single laundry item is placed in the drum, the laundry is not uniformly dispersed, with the result that vibration is generated.

If the magnitude of vibration varies depending on the extent of unbalance and the rotational speed of the motor, ripples are generated in a current value that is otherwise maintained uniform.

Since the magnitude of the ripples varies depending on the extent of unbalance, the controller 210 may sense unbalance by analyzing the ripples.

Figure 11:
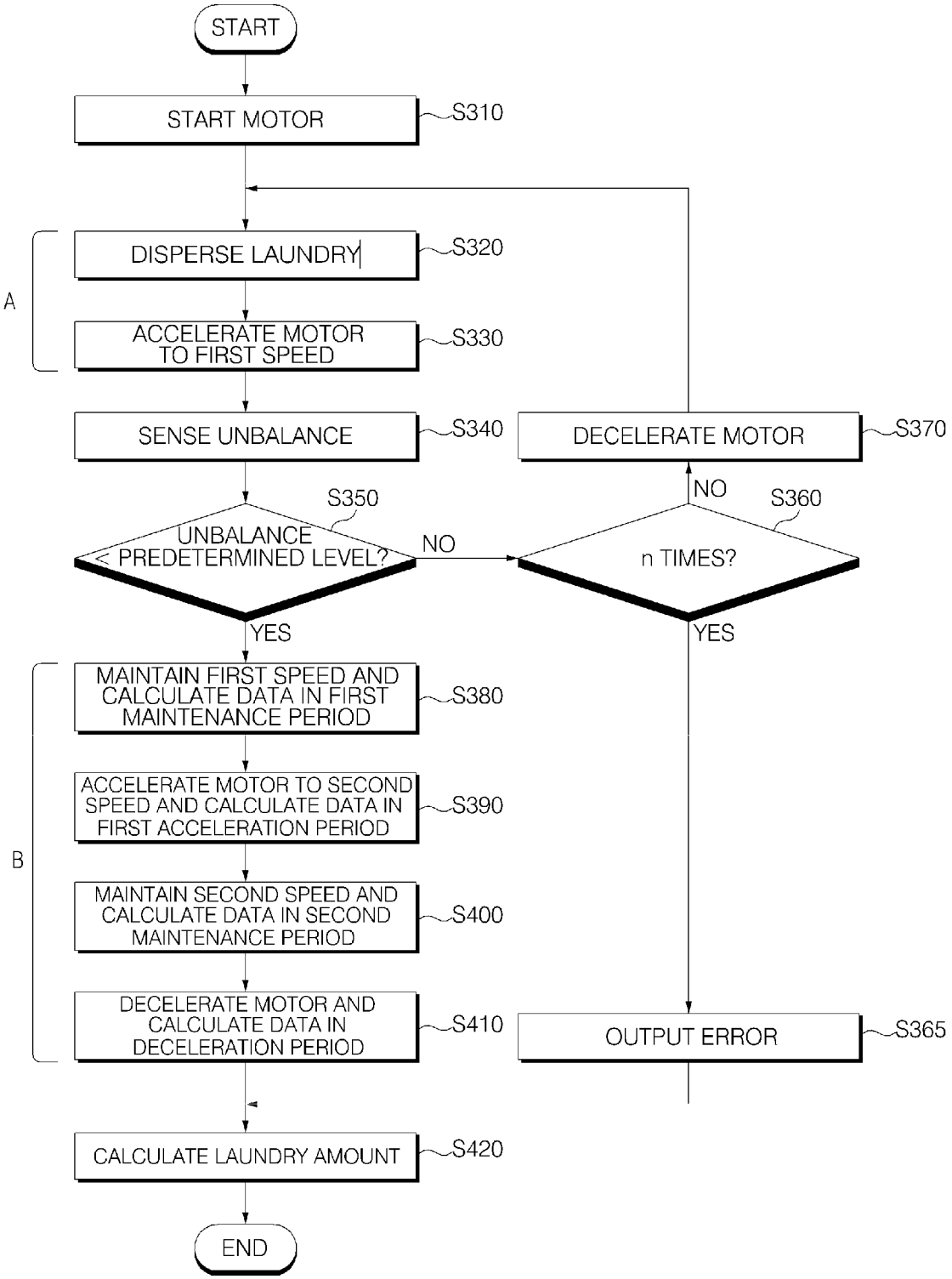
FIG. 11 is a flowchart showing a control method for measuring the amount of laundry during the first sensing period and the second sensing period in the washing machine according to the present invention.

FIG. 11 is a flowchart showing a control method for measuring the amount of laundry during the first sensing period and the second sensing period in the washing machine according to the present invention.

In order to determine the amount of laundry, the controller 210 transmits a control command for performing operations in the first sensing period A and the second sensing period B to the motor-driving unit. Unbalance is sensed in the first sensing period, and the amount of laundry is sensed in the second sensing period. In addition, laundry dispersion is performed to reduce unbalance in the first sensing period.

As shown in FIG. 11, the motor-driving unit 260 starts the motor in response to the control command (S310).

The motor-driving unit 260 accelerates the motor to a speed for laundry dispersion and maintains the rotational speed of the motor in order to perform laundry dispersion (S320).

The motor-driving unit 260 maintains or accelerates the rotational speed of the motor within a range from the speed for laundry dispersion to a first speed S13 (S2) in order to execute a first sensing period A (S330). The first speed S13 (S2) is a speed at which all of the laundry rotates along with the drum in the state of clinging to the wall of the drum.

The current-sensing unit 280 measures a current value in the first sensing period A, and transmits the measured current to the controller 210.

The controller 210 analyzes the current measured in the first sensing period A to sense unbalance (340), and compares the sensed unbalance with a predetermined level (S350).

For example, the controller 210 may analyze ripples in the current measured in the first sensing period A to sense unbalance. At this time, a reference level for determining the unbalance is set differently based on the amount of laundry. Since the amount of laundry has not yet been measured, however, a reference level of unbalance in the case in which the amount of laundry is large is set to a predetermined level in order to determine the unbalance.

If the unbalance is equal to or higher than the predetermined level, the controller 210 transmits a control command to the motor-driving unit 260 such that the first sensing period A is executed again.

At this time, the controller 210 determines the number of times the first sensing period has been repeated (S360). If a predetermined number of times n has not yet been reached, the controller 210 performs control such that the first sensing period is repeated.

Consequently, the motor-driving unit 260 brakes the motor to decelerate the rotational speed of the motor (S370), and the first sensing period A is executed again.

The motor-driving unit 260 decelerates the motor to the speed for laundry dispersion, maintains the rotational speed of the motor to perform laundry dispersion (S320), and accelerates the motor to the first speed S13 (S2) in a stepwise manner (S330).

The controller 210 senses unbalance again based on the current received from the current-sensing unit (S340). If the unbalance is equal to or higher than the predetermined level, the controller 210 performs control such that the first sensing period is executed again (S360, S370, and S320 to S340).

If the unbalance is lower than the predetermined level, the controller 210 controls the motor-driving unit 260 such that the second sensing period B is executed.

The motor-driving unit 260 maintains the rotational speed of the motor at the first speed S13 (S2) for a predetermined amount of time, and the current-sensing unit 280 measures data, i.e. current, in a first maintenance period D01, during which the rotational speed of the motor is maintained at the first speed, and transmits the measured current to the controller 210 (S380).

In addition, the motor-driving unit 260 accelerates the rotational speed of the motor from the first speed to a second speed S14 (S3), and the current-sensing unit 280 measures data, i.e. current, in a first acceleration period D02, during which the rotational speed of the motor is accelerated to the second speed, and transmits the measured current to the controller 210 (S390).

When the rotational speed of the motor reaches a second speed S14 (S3), the motor-driving unit 260 maintains the rotational speed of the motor at the second speed for a predetermined amount of time, and the current-sensing unit 280 measures current in a second maintenance period D03, during which the rotational speed of the motor is maintained at the second speed, and transmits the measured current to the controller 210 (S400).

The motor-driving unit 260 brakes the motor to decelerate the rotational speed of the motor, and the current-sensing unit 280 measures current in a deceleration period D04, during which the rotational speed of the motor is decelerated, and transmits the measured current to the controller 210 (S410).

The motor-driving unit 260 brakes the motor to decelerate the rotational speed of the motor, and the motor is stopped.

When the operation in the second sensing period B finishes normally, the controller 210 calculates the average of current values on a per-period basis based on the data received during the second sensing period B, i.e. the current values in the first and second maintenance periods, the first acceleration period, and the deceleration period, and calculates counter-electromotive force in the deceleration period in order to determine the amount of laundry (S420).

The controller 210 calculates the characteristics of gravity in the maintenance periods and the characteristics of inertia in the acceleration period from the current values in order to determine the amount of laundry. As the amount of laundry increases, the effects of gravity and inertia increase. Consequently, it is possible to determine the amount of laundry by extracting the characteristics of gravity and inertia from the measured currents and multiplying the resultant value by counter-electromotive force. The characteristics of inertia may be extracted by subtracting data in the maintenance periods from data in the acceleration period.

Meanwhile, if the unbalance is equal to or higher than the predetermined level and the number of times of re-execution reaches a predetermined number of times n, the controller 210 performs control such that the operation is finished without executing the second sensing period B.

Since the amount of laundry has not been sensed due to the unbalance, the controller 210 outputs an error for the unbalance through the output unit (S365).

At this time, in the case in which unbalance is sensed and laundry dispersion is performed in the first sensing period, an error is output, and the operation is stopped. Depending on the circumstances, the amount of laundry may be set as desired in order to perform the next operation.

Meanwhile, in the case in which unbalance is sensed and laundry-amount sensing and laundry dispersion are performed in the first sensing period, the amount of laundry may be determined based on data sensed in the first sensing period (S420).

Figure 12:
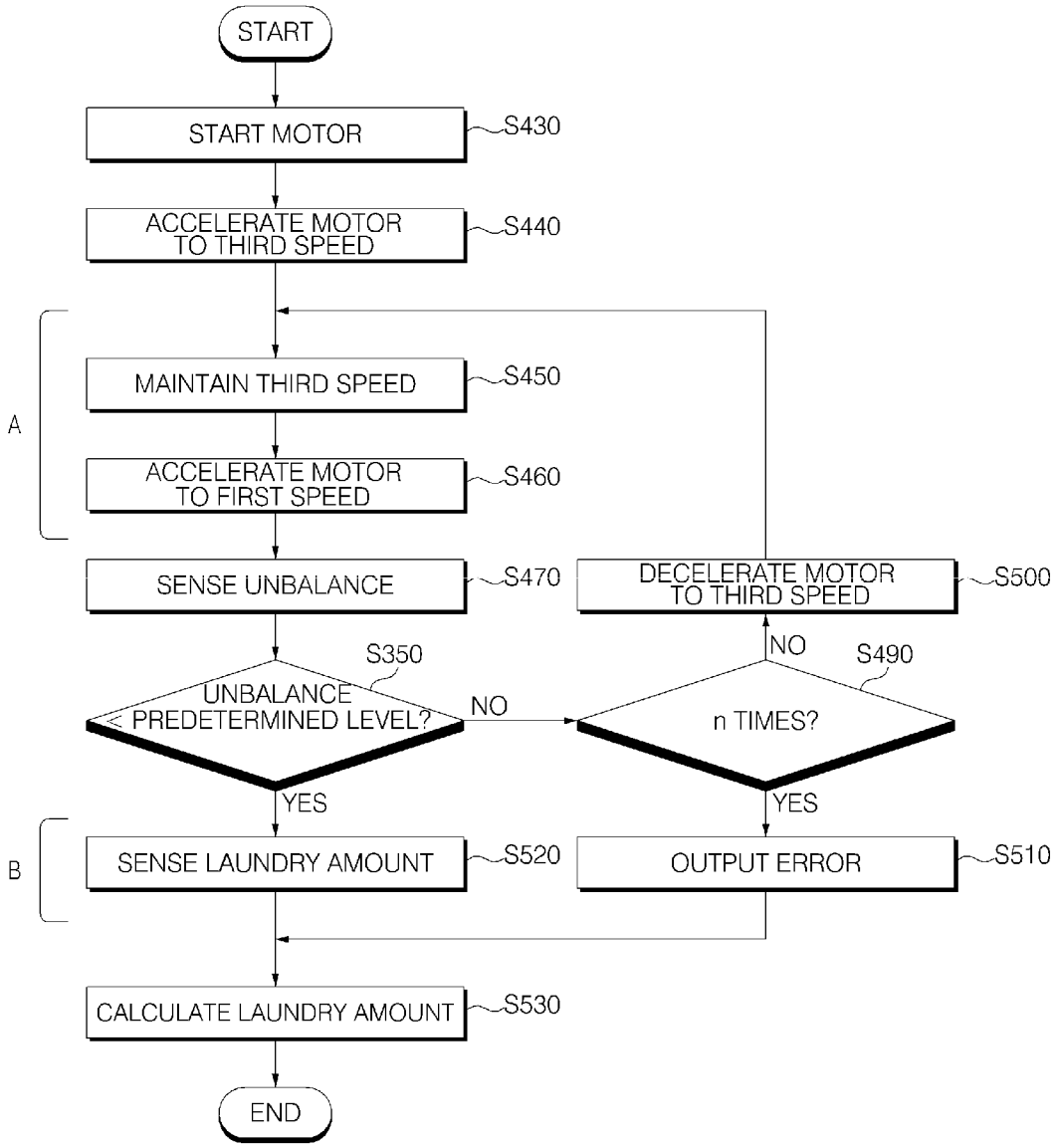
FIG. 12 is a flowchart showing a control method for measuring the amount of laundry based on a change in the speed of the motor during the first sensing period shown in FIG. 11.

FIG. 12 is a flowchart showing a control method for measuring the amount of laundry based on a change in the speed of the motor during the first sensing period shown in FIG. 11.

Hereinafter, the operation in the first sensing period, described with reference to FIG. 11, will be described in more detail.

As shown in FIG. 12, in response to the control command from the controller, the motor-driving unit 260 starts the motor 270 (S430), and accelerates the motor until the rotational speed of the motor reaches a third speed S1 (S440).

The third speed S1 is a rotational speed of the motor at which centrifugal force generated in the drum by the rotation of the motor is equal to gravity and at which the laundry does not cling to the wall of the drum due to the rotation of the drum but is lifted up and drops, whereby the movement of laundry is the greatest. The third speed S1 is lower than the first speed S2.

When the rotational speed of the motor reaches the third speed S1, the motor-driving unit 260 maintains the rotational speed of the motor at the third speed S1 for a predetermined amount of time in order to perform laundry dispersion such that the laundry is dispersed in the drum (S450).

The motor-driving unit 260 accelerates the rotational speed of the motor from the third speed S1 to a first speed S2 (S460). The first speed is a rotational speed of the motor at which the laundry completely clings to the wall of the drum due to centrifugal force and rotates along with the drum without dropping.

When the rotational speed of the motor reaches the first speed S2, the controller 210 analyzes a current value in the first sensing period, sensed by the current-sensing unit, to sense unbalance of the laundry (S470).

If the laundry is tangled, the laundry is collected at one side, with the result that vibration occurs. The controller 210 senses unbalance due to the collection of the laundry at one side.

When the unbalance is equal to or higher than the predetermined level, the controller 210 determines that high-speed rotation is not possible due to vibration caused by the unbalance, and controls the motor-driving unit 260 such that the first sensing period A is executed again in order to disperse the laundry.

At this time, the amount of laundry has not been yet determined. Consequently, the predetermined level is set based on a reference level of unbalance in the case in which the amount of laundry is large.

The controller 210 counts the number of repetitions of the first sensing period to determine whether the first sensing period has been executed at least a predetermined number of times (S490). If the predetermined number of times has not been reached, the controller 210 performs control such that the first sensing period is executed again. If the predetermined number of times has been reached, the controller 210 outputs an error indicating unbalance or an error indicating that it was not possible to determine the amount of laundry (S510).

When the number of repetitions of the first sensing period is less than the predetermined number of times, the motor-driving unit 260 brakes the motor to decelerate the rotational speed of the motor to the third speed S1 (S500).

When the rotational speed of the motor is decelerated to the third speed, as previously described, the motor-driving unit 260 performs control such that the rotational speed of the motor is maintained at the third speed to perform laundry dispersion, and unbalance is sensed again to determine the unbalance (S450 to S470).

Meanwhile, when the unbalance is lower than the predetermined level, the controller 210 controls the motor-driving unit 260 such that the second sensing period B for laundry-amount sensing is executed.

As previously described, in the second sensing period, the motor-driving unit 260 maintains the rotational speed of the motor at the first speed S2 for a predetermined amount of time, accelerates the motor to a second speed S3, maintains the rotational speed of the motor at the second speed for a predetermined amount of time, and brakes the motor to decelerate the rotational speed of the motor.

The second speed S3 is set as a rotational speed of the motor which is higher than the first speed S2, at which the effect of gravity is less as centrifugal force in the drum increases, i.e. at which the effect of gravity applied to the laundry is approximately zero, and at which no resonance occurs.

The current-sensing unit 280 measures currents in a first maintenance period, during which the rotational speed of the motor is maintained at the first speed, an acceleration period, during which the rotational speed of the motor is accelerated to the second speed, a second maintenance period, during which the rotational speed of the motor is maintained at the second speed, and a deceleration period constituting the second sensing period B, and transmits the measured currents to the controller.

When the second sensing period B is executed normally and data in the maintenance periods, the acceleration period, and the deceleration period are received, the controller 210 analyzes the data to determine the amount of laundry (S530).

The controller 210 calculates the average of the currents on a per-period basis, calculates counter-electromotive force in the deceleration period, adds or subtracts the average of the currents, multiplies the resultant value by the counter-electromotive force in order to calculate a sensed value for determining the amount of laundry, and compares the sensed value with laundry-amount data to finally determine the amount of laundry.

Figure 13:
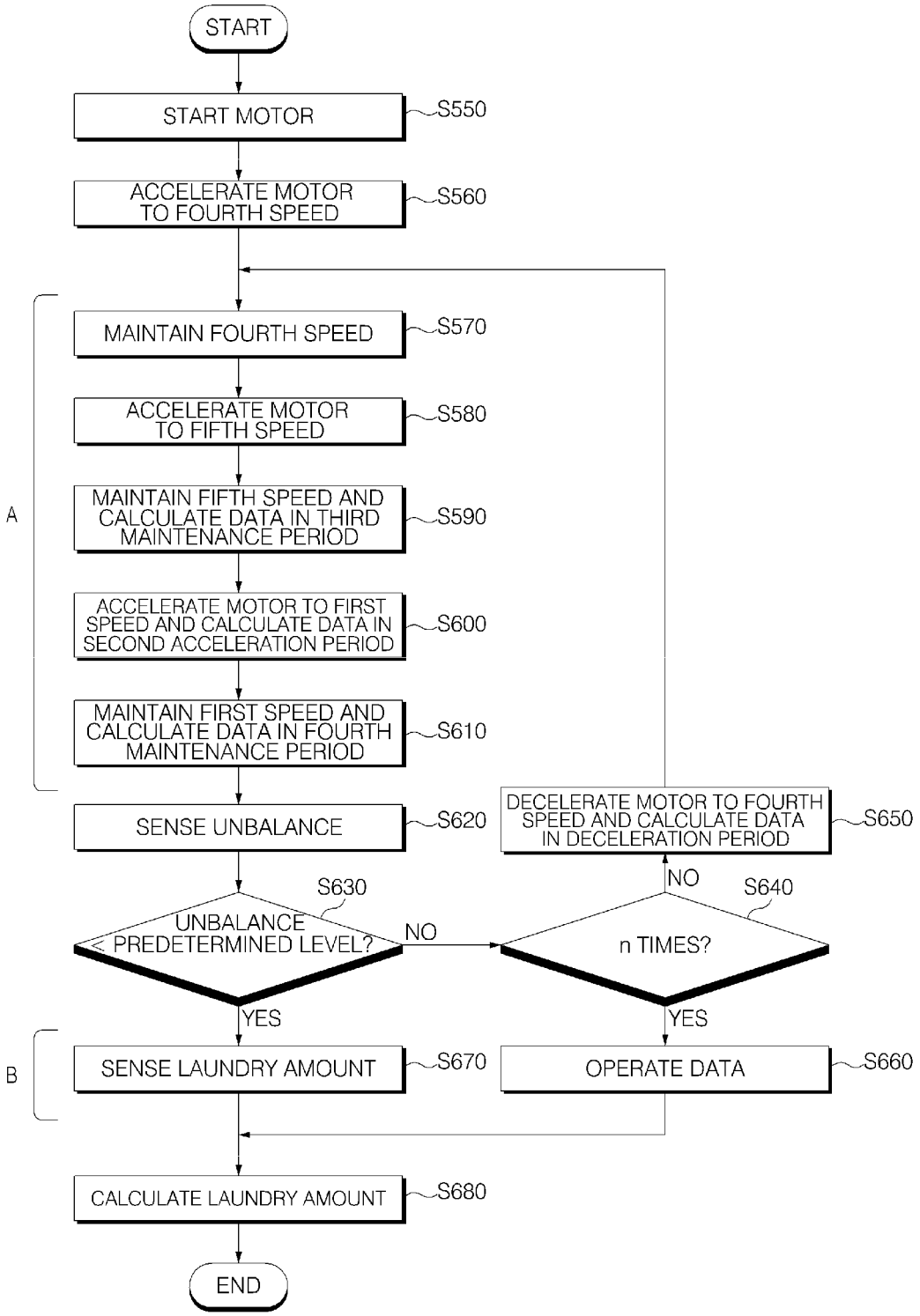
FIG. 13 is a flowchart showing another example of a control method for measuring the amount of laundry based on a change in the speed of the motor during the first sensing period shown in FIG. 11.

FIG. 13 is a flowchart showing another example of a control method for measuring the amount of laundry based on a change in the speed of the motor during the first sensing period shown in FIG. 11.

In the first sensing period described with reference to FIG. 11, the washing machine may perform an operation that is different from the operation shown in FIG. 12. Another example of the operation in the first sensing period is as follows.

As shown in FIG. 13, in response to the control command from the controller, the motor-driving unit 260 starts the motor 270 (S550), and accelerates the motor until the rotational speed of the motor reaches a fourth speed S11 (S560).

When the rotational speed of the motor reaches the fourth speed S11, the motor-driving unit 260 maintains the rotational speed of the motor at the fourth speed S11 for a predetermined amount of time (S570). Consequently, the first sensing period A is executed.

Here, the fourth speed S11 is set as the rotational speed of the motor at which the laundry tumbles in the rotating drum.

In addition, a fifth speed S12, a description of which will follow, is set as the rotational speed of the motor at which the laundry starts to cling to the wall of the drum by centrifugal force generated in the drum as the rotational speed of the motor increases, at which some of the laundry rotates along with the drum in the state of clinging to the wall of the drum, and at which some of the laundry is lifted up and dropped by the rotation of the drum. The rotational speeds may be changed depending on the size of the drum and the kind and performance of the motor.

The fourth speed is lower than the third speed, and the fifth speed is higher than the third speed and lower than the first speed.

The motor-driving unit 260 accelerates the rotational speed of the motor from the fourth speed to the fifth speed S12 (S580). When the rotational speed of the motor reaches the fifth speed, the motor-driving unit 260 maintains the rotational speed of the motor at the fifth speed for a predetermined amount of time (S590). At this time, the current-sensing unit 280 measures current in a third maintenance period during which the rotational speed of the motor is maintained at the fifth speed, and transmits the measured current to the controller as data in the third maintenance period.

In addition, the motor-driving unit 260 accelerates the rotational speed of the motor from the fifth speed to the first speed S13 (S2). When the rotational speed of the motor reaches the first speed, the motor-driving unit 260 maintains the rotational speed of the motor at the first speed for a predetermined amount of time (S610). The current-sensing unit 280 measures currents in a second acceleration period during which the rotational speed of the motor is accelerated to the first speed and a fourth maintenance period during which the rotational speed of the motor is maintained at the first speed, and transmits the measured currents to the controller.

In this way, the controller 210 controls the motor-driving unit 260 such that the rotational speed of the motor is maintained at the fourth speed, the fifth speed, and the first speed for a predetermined amount of time and such that the rotational speed of the motor is accelerated in a stepwise manner, whereby the laundry tumbles in the drum or some of the laundry rotates while some of the laundry drops. Consequently, laundry dispersion is performed in the first sensing period. In addition, the controller performs control such that laundry-amount sensing as well as unbalance sensing is performed in the first sensing period based on currents in the maintenance periods and the acceleration period, measured by the current-sensing unit.

The controller 210 analyzes the current in the first sensing period, received from the current-sensing unit, to sense unbalance.

When the unbalance is equal to or higher than the predetermined level, the controller 210 determines that high-speed rotation is not possible, and performs control such that the first sensing period is executed again in order to disperse the laundry.

The controller 210 determines whether the number of repetitions of the first sensing period has reached a predetermined number of times n (S640). If the number of repetitions of the first sensing period has not reached the predetermined number of times, the controller 210 generates a control command for executing the first sensing period again and transmits the generated control command to the motor-driving unit.

The motor-driving unit decelerates the rotational speed of the motor to the fourth speed and drives the motor such that the first sensing period is executed again (S650). At this time, the current-sensing unit measures data in the deceleration period, and transmits the measured data to the controller.

If the unbalance is lower than the predetermined level, the controller 210 performs control such that the second sensing period is executed in order to perform laundry-amount sensing.

In response to the control command from the controller, the motor-driving unit 260 maintains the rotational speed of the motor at the first speed for a predetermined amount of time, accelerates the motor to the second speed, and maintains the rotational speed of the motor at the second speed for a predetermined amount of time. In addition, the current-sensing unit measures currents in the first maintenance period during which the rotational speed of the motor is maintained at the first speed, the acceleration period during which the rotational speed of the motor is accelerated to the second speed, and the maintenance period during which the rotational speed of the motor is maintained at the second speed, and transmits the measured currents to the controller.

In addition, the motor-driving unit 260 brakes the motor, which is being rotated at the second speed, to stop the motor. The current-sensing unit measures current in the deceleration period, and transmits the measured current to the controller.

Consequently, the controller 210 analyzes the current value measured in the second sensing period B to determine the amount of laundry (S680).

At this time, the controller 210 discards data in the third and fourth maintenance periods, the second acceleration period, and the second deceleration period, during which the rotational speed of the motor is decelerated to the fourth speed, of the first sensing period A, and determines the amount of laundry based on data measured in the second sensing period B.

Meanwhile, if the unbalance is equal to or higher than the predetermined level, with the result that the first sensing period is repeated a predetermined number of times and the second sensing period is not executed, the controller finishes the operation of sensing the amount of laundry and outputs an error.

In addition, as the operation is finished without executing the second sensing period, the controller analyzes data measured in the first sensing period, i.e. data in the third and fourth maintenance periods, the second acceleration period, and the second deceleration period, during which the rotational speed of the motor is decelerated to the fourth speed, in order to determine the amount of laundry.

As the first sensing period A is repeated a predetermined number of times, the controller 210 calculates the average of data measured every time on a per-period basis or selects data finally sensed in the first sensing period to determine the amount of laundry.

In this case, it is possible to calculate the amount of laundry even though the second sensing period is not executed, and therefore the next operation may be performed.

Figure 14:
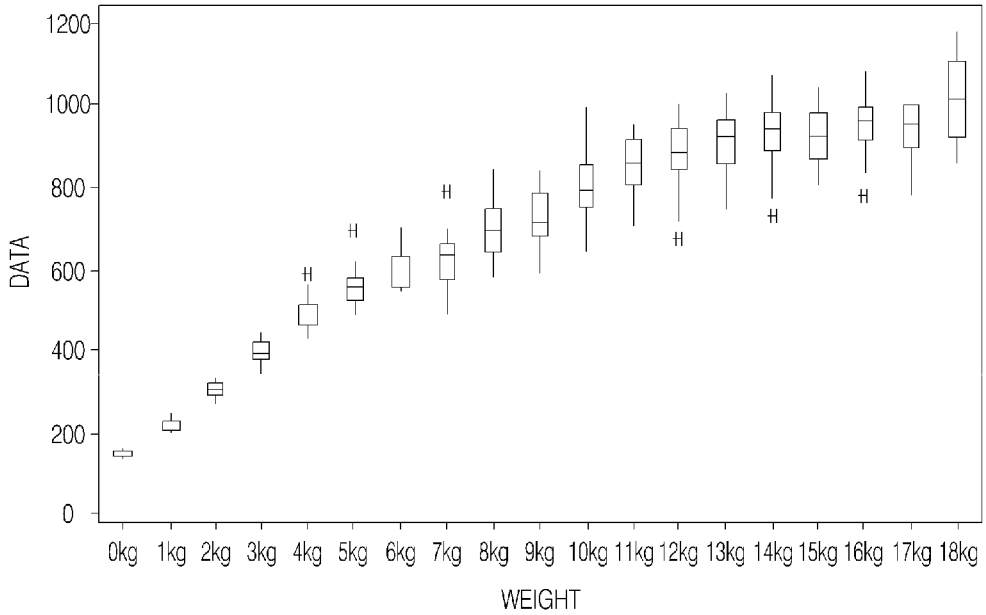
FIG. 14 is a view showing the results of measurement of the amount of laundry based on the weight of laundry in the washing machine according to the present invention.
Figure 14:
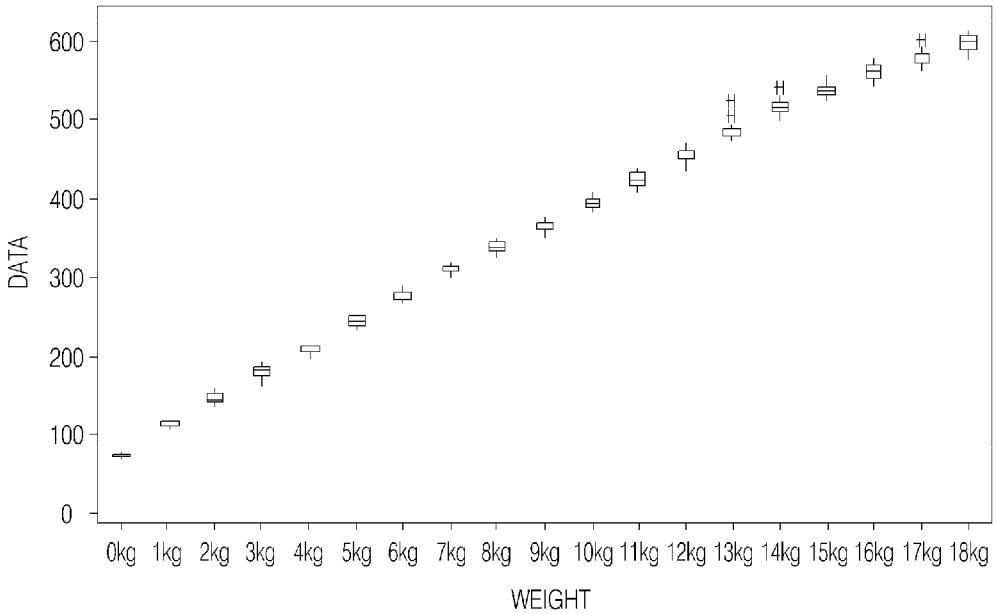

FIG. 14 is a view showing the results of measurement of the amount of laundry based on the weight of laundry in the washing machine according to the present invention.

FIG. 14(*a*) is a view showing the results of determination of the amount of laundry based on the weight of laundry in a conventional washing machine, and FIG. 14(*b*) is a view showing the results of determination of the amount of laundry based on the weight of laundry in the washing machine according to the present invention.

As shown in FIG. 14(*a*), the conventional washing machine determines the amount of laundry using a current value measured at the time of starting the motor. In the conventional washing machine, the sensed values for laundry having a weight of 6 kg or more are distributed in an overlapping manner, whereby it is difficult to determine an amount of laundry having a weight of 6 kg or more. In particular, as the weight of laundry increases, it is not possible to precisely determine the amount of laundry.

For example, in the case in which the laundry-amount sensing value, determined based on the current value, is 600, it is difficult to determine whether the weight of the laundry contained in the drum is 6 kg or 8 kg.

Also, in the case in which the laundry-amount sensing value is 900, it is difficult to specify the weight of the laundry contained in the drum, since laundry articles having a weight of 12 kg to 18 kg have the same distribution.

As shown in FIG. 14(*b*), in the washing machine according to the present invention, the first sensing period and the second sensing period are divided from each other, and the amount of laundry is determined using the current value measured in the second sensing period, i.e. at a rotational speed of the motor that is higher than the rotational speed of the motor at which the entirety of the laundry clings to the wall of the drum, whereby the sensed values are calculated linearly in proportion to the weight of the laundry. Consequently, it is possible to more easily determine the amount of laundry than in the conventional washing machine. In addition, sensed values less overlap each other, whereby it is possible to precisely determine the laundry amount.

Figure 15:
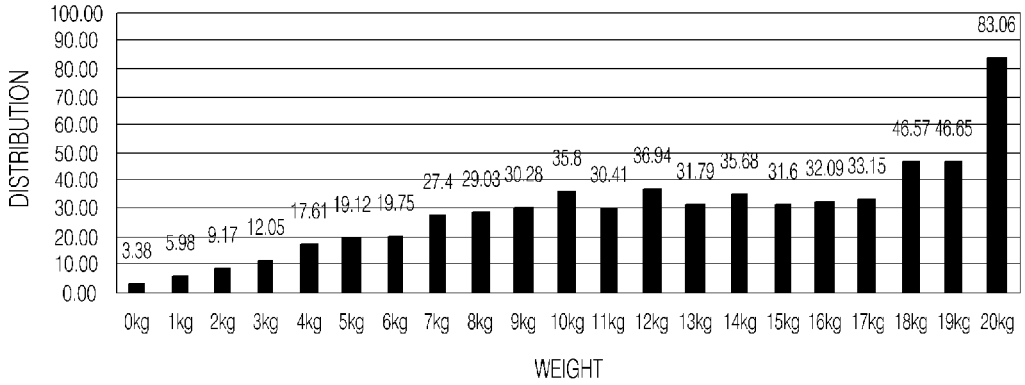
FIG. 15 is a view showing the distribution of the results of measurement of the amount of laundry based on the weight of laundry in the washing machine according to the present invention.
Figure 15:
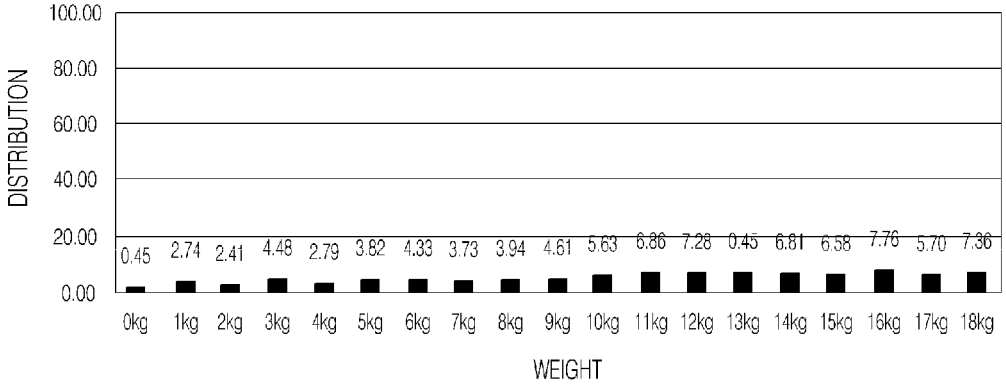

FIG. 15 is a view showing the distribution of the results of measurement of the amount of laundry based on the weight of laundry in the washing machine according to the present invention.

FIG. 15(*b*) is a view showing the distribution of laundry on a per-unit-weight basis in calculating the amount of laundry in the conventional washing machine, and FIG. 15(*a*) is a view showing the distribution of laundry on a per-unit-weight basis in calculating the amount of laundry in the washing machine according to the present invention.

As shown in FIG. 15(*a*), it can be seen that, when laundry is introduced into the washing machine and the amount of laundry is measured, deviation in the results of measurement of the amount of laundry based on the same weight of laundry is high, meaning that the distribution of sensed values is high.

For example, distribution at 3 kg is 12.05, which means that it is difficult to specify the value thereof starting from 3 kg. In particular, distribution at 7 kg or more is 27.04. Distribution continuously increases proportional to the weight of laundry. Distribution at 18 kg is 46.57. Whenever the weight of the same laundry is measured, therefore, the sensed value is acquired differently. As a result, it is difficult to set the weight of laundry based on the sensed value.

As shown in FIG. 15(*b*), in the washing machine according to the present invention, the amount of laundry is determined based on data in the second sensing period. Consequently, it can be seen that the distribution of the sensed values based on the weight of laundry is lower than in the conventional washing machine.

Distribution based on the weight of laundry is 10 or less, which means that it is possible to precisely measure the amount of laundry based on the sensed values.

In the present invention, therefore, the current of the motor at the time of starting the motor is not measured, but the current of the rotating motor in the maintenance period, in which the rotational speed of the motor is maintained, the acceleration period, and the deceleration period is measured, and counter-electromotive force is calculated in order to determine the amount of laundry. Consequently, it is possible to exclude instability of current at the time of starting the motor. In the present invention, the rotational speed of the motor is controlled so as to be equal to or higher than the rotational speed of the motor at which the laundry rotates in the state of clinging to the wall of the drum in order to determine the amount of laundry. Consequently, it is possible to minimize distribution due to the movement of the laundry, and therefore it is possible to more precisely determine the amount of laundry. Also, in consideration of the possibility of vibration being generated due to high-speed rotation, unbalance is sensed in the first sensing period, making it possible to rotate the motor stably. Furthermore, it is possible to determine the amount of laundry based on data measured in the first sensing period even when the second sensing period is not executed.

As is apparent from the above description, in the washing machine according to the present invention and the method of controlling the same, the amount of laundry that is introduced into the washing machine is measured using gravity and inertia applied during the operation of the motor, whereby it is possible to precisely calculate the amount of laundry and to minimize the effects of the initial position of the laundry and the movement of the laundry. In addition, the current value of the motor that is operated is used to measure the amount of laundry without a sensor.

Furthermore, in the present invention, the rotational speed of the motor is controlled so as to be equal to or higher than the rotational speed of the motor at which the laundry rotates in the state of clinging to the wall of the drum, and the amount of laundry is determined based on data in the maintenance period, the acceleration period, and the deceleration period. Consequently, it is possible to minimize distribution due to the movement of the laundry, and therefore it is possible to more precisely determine the amount of laundry.

Although all components constituting an embodiment of the present invention have been described as being combined into a single unit and operated as the single unit, the present invention is not limited to this embodiment. Depending upon embodiments, the components may be selectively combined into one or more units and operated as the one or more units within the scope of the object of the present invention.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

Therefore, the present invention has been made in view of the above problems, and it is an object of the present invention to provide a washing machine capable of rapidly and precisely determining the amount of laundry that is introduced thereinto, precisely measuring the amount of laundry even in the case in which the washing machine includes a sensorless motor, and easily performing a spin-drying operation based on the amount of laundry, thereby reducing washing time, and a method of controlling the same.

In accordance with an aspect of the present invention, the above and other objects can be accomplished by the provision of a washing machine including a motor connected to a drum for rotating the drum, a motor-driving unit for supplying operating power to the motor to operate or stop the motor and to control the motor such that the rotational speed of the motor is maintained, accelerated, or decelerated, a current-sensing unit for measuring current of the motor during operation of the motor, and a controller for transmitting a control command for controlling the motor to the motor-driving unit in order to determine the amount of laundry contained in the drum and determining the amount of laundry based on a current value received from the current-sensing unit, wherein the controller divides a sensing period during which an operation is performed into a first sensing period for laundry dispersion and a second sensing period for laundry-amount sensing based on the rotational speed of the motor, determines whether the second sensing period is to be executed based on unbalance sensed in the first sensing period, and calculates the amount of laundry based on data measured in the second sensing period.

In accordance with another aspect of the present invention, there is provided a method of controlling a washing machine including starting a motor in order to determine the amount of laundry contained in a drum, rotating the motor at a low speed to perform laundry dispersion in a first sensing period, sensing unbalance based on data measured in the first sensing period, when the unbalance is equal to or higher than a predetermined level, executing the first sensing period again to disperse the laundry, when the unbalance is lower than the predetermined level, executing a second sensing period and controlling the rotational speed of the motor in a stepwise manner to perform laundry-amount sensing, and dividing data measured in the second sensing period into data in a maintenance period, an acceleration period, and a deceleration period, which are divided based on the rotational speed of the motor, and analyzing the data in the second sensing period to calculate the amount of laundry.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A washing machine comprising:

a motor coupled to a drum and configured to rotate the drum;

a motor driver configured to supply power to the motor and to control the motor to operate or stop and to control a rotational speed of the motor based on a control command from a controller;

a current-sensing unit including a current sensor configured to measure current of the motor during operation of the motor; and the controller configured to provide, to the motor driver, the control command for controlling the motor in order to determine an amount of laundry in the drum based on at least a current value received from the current-sensing unit, wherein the controller is configured to perform an operation including laundry dispersion operation during a first sensing period and laundry-amount sensing operation during one of the first sensing period and a second sensing period, wherein the controller is configured to perform the laundry dispersion operation by:

controlling the motor driver such that the rotational speed of the motor is maintained at a third speed, and accelerated to a first speed which is higher than the third speed during the first sensing period, wherein the controller is configured to:

based on a level of unbalance being determined to be less than a predetermined level, perform the second sensing period, and determine the amount of laundry based on data obtained during the second sensing period, wherein the level of unbalance is determined based on current value measured by the current-sensing unit at time point that the rotational speed of the motor reaches the first speed in the first sensing period, wherein the controller is configured to perform the laundry-amount sensing operation during the second sensing period by:

controlling the motor driver such that the rotational speed of the motor is accelerated, maintained, and decelerated in a stepwise manner within a range between the first speed and a second speed which is higher than the first speed during the second sensing period, and determine the amount of laundry based on the current value received from the current-sensing unit in a maintenance period, an acceleration period and a deceleration period during the second sensing period, wherein the controller is configured to:

store, as data, the current value received from the current-sensing unit during the first sensing period, when the level of unbalance is determined to be equal to or greater than a predetermined level, decelerate the rotational speed of the motor from the first speed to the third speed and perform such that the laundry dispersion operation is executed again, and when the laundry dispersion operation is repeated a predetermined number of times, the controller is configured to finish the operation of determining the amount of laundry without executing the second sensing period and analyze the data obtained during the first sensing period into data in a maintenance period, data in an acceleration period, and data in a deceleration period, and determine the amount of the laundry by analyzing the current value on the maintenance period, the acceleration period, and the deceleration period of the first sensing period, wherein when the level of unbalance is determined to be less than the predetermined level before a repetition of the laundry dispersion operation is exceeded the predetermined number of times, the controller is configured to discard the data during the first sensing period and determine the amount of laundry based on the data during the second sensing period.

2. The washing machine according to claim 1, wherein the controller is configured to:

analyze the current value received from the current-sensing unit during the second sensing period, in the acceleration period, the maintenance period, and the deceleration period in order to determine the amount of laundry, and determine the amount of laundry by analyzing the current value on the maintenance period, the acceleration period, and the deceleration period.

3. The washing machine according to claim 1, further comprising an output unit including a display and configured to output an information about an operation state of the washing machine, wherein when the level of unbalance is determined to be equal to or greater than the predetermined level, the controller performs control such that the laundry dispersion operation is executed again in order to disperse the laundry in the first sensing period, to sense the level of unbalance again, and to determine that an error has occurred when the laundry dispersion operation is repeated a predetermined number of times and to output an error through the output unit.

4. The washing machine according to claim 1, wherein, in response to the control command, during the second sensing period, the motor driver is configured to:

maintain the rotational speed of the motor at the first speed for a predetermined amount of time, accelerate the rotational speed of the motor to the second speed, at which the laundry is less affected by gravity as centrifugal force in the rotating drum increases to an extent that an effect of the gravity applied to the laundry is approximately zero, and at which resonance does not occur, maintain the rotational speed of the motor at the second speed for a predetermined amount of time, and decelerate the rotational speed of the motor to stop by braking the motor.

5. The washing machine according to claim 1, wherein, the third speed is a rotational speed of the motor at which the laundry does not cling to the drum due to rotation of the drum but the laundry is lifted up and drops, whereby movement of the laundry is greatest for a predetermined amount of time.

6. The washing machine according to claim 2, wherein the controller is configured to:

determine an average of the current values in the maintenance period during the second sensing period, determine an average of the current values in the acceleration period during the second sensing period, determine an average of the current values in the deceleration period during the second sensing period, calculate counter-electromotive force in the deceleration period, and calculate a resultant value by subtracting average data in the maintenance period from average data in the acceleration period, and multiply the resultant value by the counter-electromotive force.

* * * * *